US008800071B2

(12) United States Patent
Sánchez Moreno

(10) Patent No.: US 8,800,071 B2
(45) Date of Patent: Aug. 12, 2014

(54) METHODS AND SYSTEMS FOR COLLECTING AND DISPOSING OF HUMAN WASTE

(76) Inventor: Jaime Alberto Sánchez Moreno, San Pedro (MX)

( * ) Notice: Subject to any disclaimer, the term of this patent is extended or adjusted under 35 U.S.C. 154(b) by 916 days.

(21) Appl. No.: 12/962,721

(22) Filed: Dec. 8, 2010

(65) Prior Publication Data

US 2012/0144575 A1 Jun. 14, 2012

(51) Int. Cl.
*A61G 9/00* (2006.01)

(52) U.S. Cl.
USPC ..... 4/452

(58) Field of Classification Search
USPC ..... 4/450–456
See application file for complete search history.

(56) References Cited

U.S. PATENT DOCUMENTS

| | | | | |
|---|---|---|---|---|
| 727,949 | A * | 5/1903 | Hoffman | 4/450 |
| 1,251,877 | A * | 1/1918 | Erickson | 4/450 |
| 3,936,890 | A | 2/1976 | Oberstein | |
| 4,011,610 | A | 3/1977 | Parker, III | |
| 4,899,399 | A | 2/1990 | Young | |
| 5,133,130 | A | 7/1992 | Podolsky | |
| 5,689,840 | A * | 11/1997 | Kuhlman | 4/452 |
| 6,385,790 | B1 | 5/2002 | Abraham | |
| 2003/0159207 | A1 | 8/2003 | Howell | |
| 2003/0221249 | A1 | 12/2003 | Shirkey | |
| 2009/0089923 | A1 | 4/2009 | Georgieva | |
| 2010/0175178 | A1 | 7/2010 | Mrugala | |
| 2010/0180370 | A1 | 7/2010 | Helewa | |

FOREIGN PATENT DOCUMENTS

| | | | |
|---|---|---|---|
| WO | WO/01/45543 | A1 | 6/2001 |
| WO | WO/2006/009561 | A | 1/2006 |
| WO | WO/2007/046961 | | 4/2007 |
| WO | WO/2007/046961 | A1 | 4/2007 |
| WO | WO/2009/073983 | A1 | 7/2009 |
| WO | WO/2010/001163 | A1 | 7/2010 |

* cited by examiner

*Primary Examiner* — Huyen Le

(57) ABSTRACT

Systems and methods for collecting biological waste from a human person are disclosed. In various embodiments, the disclosed systems can have a bedpan with a receptacle base and a floor, a side wall extending from the floor, and a substantially open top. In various embodiments, disclosed systems can have a lid engagable to cover the substantially open top, the lid being provided with an aperture therethrough. Some embodiments of the present systems can have a disposable bag having dimensions so as to allow the disposable bag to cover the bedpan, and to line the interior. Some embodiments of the present invention can have a disposable bag dispenser configured to store and dispense a disposable bag prior to use by the human person. Various embodiments of the present systems can have an elongate, substantially planar spatula to facilitate use of the disclosed systems. Methods for using the disclosed systems are further disclosed.

19 Claims, 31 Drawing Sheets

METHODS AND SYSTEMS FOR COLLECTING AND DISPOSING OF HUMAN WASTE

BACKGROUND OF THE INVENTION

1. Field of the Invention

The present invention relates generally to systems and methods for facilitating the collection and disposal of human waste. More particularly, the present invention relates to systems and methods for collecting human waste from a bedridden person without requiring him to leave his bed, and the disposal of such waste without contamination of an assistant.

2. Background

Many people become confined to bed for various reasons, either for short periods such as a few days, or for longer periods such as several months or even years. Such situations are often occur when a person is confined to a hospital or to a home bed with a nurse attendant or other home health provider to assist the person in attending to their various needs. In such circumstances, bedridden people, such as hospital patients, will need to accommodate all their physiological needs from their bed, including eating washing, and defecating and voiding. Often, patients confined to bed need assistance in taking care of their physiological needs.

Often patients confined to a bed are assisted with their physiological needs through the use of a bedpan, commonly made of plastic or stainless steel. Presently, there are two types of bedpans in wide use. One type is designed for patients having some mobility in bed, and who can be rolled over. This type of bedpan can be emplaced under a patient by rolling the patient over and then placing the bedpan below the patient, and then rolling the patient back onto the pan to evacuate. For patients who have more serious injuries preventing them from moving around very much in bed, such as patients with bone fractures requiring immobilization to promote healing, another type of bedpan is often used, which is often called a "fracture" bedpan. These types of bedpans are generally shaped like a wedge when viewed in profile from the side, facilitating the sliding of the fracture bedpan under the patient directly from the front, or under the patient's upper thighs and buttocks.

Presently, when a bedridden patient needs assistance with evacuating, depending on his degree of mobility, the placing of the bedpan may require more than one caregiver. In one method to position the bedpan under the patient's buttocks, one or more caregivers roll the patient over one of his sides, the bedpan is emplaced under his buttocks, and then the patient is rolled back lying over the bedpan. Then, in the case of an electrically-reclinable bed, such as a hospital bed, the bed is inclined up to sit the patient over and on the bedpan. Another common method of emplacing a bedpan is to ask a patient lying horizontally on a bed, to raise his hips, or have one or more caregivers to raise the patient by his hips and buttocks, while another caregiver places the bedpan under patient's buttocks. Then the bed can be inclined to cause the patient to be sitting up over and on the bedpan.

Both of these methods to emplace a bedpan require that the patient is handled significantly, and possibly invasively, and that his private areas be greatly exposed to attendants. This may cause discomfort and embarrassment. The attendants performing these methods may be required to expend great physical effort resulting in stress on their lower backs, and possibly leading to injuries.

Once the patient has evacuated, the caregiver(s) may then recline the bed and either roll or raise the patient while another caregiver pulls the bedpan out from the patient's buttocks. Then, one of the caregivers can bring the bedpan to a commode into which the attendant may deposit all contents. Then the caregiver will have to clean the bedpan with water; depending on the resources in the facility, this may be done with a hose, in a toilet, or in a sink. This cleaning task may be unpleasant and even dangerous for caregivers since there is always the risk of splashing and contagion, both to the caregiver or to other patients and people with whom the caregiver later comes into contact.

Many conventional bedpans are designed for multiple uses and therefore need to be cleaned after each use. Patients evacuate directly into the actual bedpan itself, which then is used to contain and collect the human waste and to transport it to another receptacle or disposal location, typically a commode. Generally, an attendant must carry the human waste deposited into the bedpan and dump out of the bedpan and into a commode, flush the commode, and then wash the bedpan out for reuse. Washing the bedpan often involves a process of spraying it out with a hose or sprayer, often in a large sink. There are many shortcomings associated with this process. First, there is the possibility of splashing of the waste itself or the contaminated waste water onto the attendant, which is unpleasant and unclean. Additionally, there is a possibility that the bedpan would not get completely clean from the washing process, and some waste might cling to the bedpan, rendering it unclean for further use. This process also takes time to conduct properly.

One problem with current bedpans is their inability to comfortably and safely accommodate large, overweight, or obese patients. More and more people are obese and overweight in the United States. Such weight problems can aggravate or cause other health problems. Also, the overweight condition can make it very difficult if not impossible to move the patient in bed to position a bedpan under the patient who is bedridden. Further, current bedpans are often too narrow and therefore uncomfortable or unstable under larger or obese patients. Some bedpans are not structurally robust enough to safely accommodate large, heavy patients, and may deform or even collapse under large, heavy patients, which can be at least messy and inconvenient, and at worse dangerous or even injurious to the patient.

Modern bedpans are also not designed to be user-friendly from the perspective of the nurse or attendant who must assist in the use of the pan. For example, most bedpans lack handles or other ready and convenient handholds for use by the attendant in positioning the bedpan. This results in the attendant having to struggle with the pan and causing discomfort or embarrassment for the patient. Further, sometimes the attendant, in order to get a solid purchase on the bedpan in the course of positioning or manipulating it, may even feel forced to place his hands or fingers inside the opening of the bedpan, which may be unsanitary, messy, or otherwise undesirable, and may further cause embarrassment to the patient.

Therefore, many contemporary bedpan designs are difficult to emplace properly under a patient. Even "fracture" bedpans can be very difficult to emplace under a patient, particularly a patient who is obese or very overweight. Often, an attendant is forced to attempt to "wedge" the bedpan under the patient, which process is rendered difficult by the shape of the bedpan. Often, an attendant is forced to actually hoist or lift a patient to emplace a bedpan under him. This process may require the participation of two or more attendants, which takes up time and resources. Further, many attendants, such as those of slight build, may have trouble moving, lifting, rolling, or otherwise positioning a patient properly over a bedpan. This manipulation can even be injurious or uncomfortable to the patient. Further, the attendant(s) may become injured through lifting a heavy patient, for example if the patient suddenly shifts and they have to quickly react.

Some attendants may attempt to place a bedpan in a vertical orientation under the raised thighs and buttocks of a reclined patient, and then to sit the patient up using the power bed functionality to raise the upper body of the patient onto the bedpan. This is very difficult to do successfully, however, because the pan may move or slip during this process, or may fall over during the process of raising the patient, causing the patient to end up not centered over the receptacle hole of the bedpan or to even fall off of the bed completely, causing injury or embarrassment. One way to improve the success rate of such a maneuver is to have two or more attendants do it; one to hold the pan in place and anther to raise the bed and keep the patient centered and safely secure on the bed. Such an approach, however, has the disadvantage of requiring more than one assistant, nurse or staff member.

SUMMARY OF THE INVENTION

Systems and methods for the collection and disposal of the human waste of bedridden people are provided. The disclosed bedpan invention eliminates the need to raise or roll the patient to emplace the bedpan, and eliminates the need to clean the bedpan after every use. Embodiments of the present invention include a bedpan having a base and an articulable lid adapted to cover the base. In some embodiments the bedpan is wide enough to accommodate overweight and obese patients without instability or compromise of the structural integrity of the bedpan. In some embodiments the lid serves as a seat for the user. Embodiments of the present bedpan invention are provided with handles, such as one, two, three or more handles for use, for example, by an attendant for the placement, positioning, removal, and carriage of the bedpan. Some embodiments of the present invention include a flexible liner bag, such as a disposable bag adapted to receive the human waste and, in some embodiments, to cover the bedpan exterior surface. Various embodiments of the present invention incorporate a dispenser of bags adapted to dispense a new flexible liner and cover bag. Some embodiments incorporate a placement spatula coupled to the bedpan and adapted to maintain the bedpan in an inclined position to facilitate the placement of the bedpan under a user.

When a patient needs to evacuate in bed, methods according to the present invention include using a bed, such as a hospital bed, that can be electrically reclined and can also be articulated at approximately the hip level of the bed occupant to raise the upper body or torso of the occupant to approximate a sitting position. Starting from a horizontal, reclined position, a patient can bend or have his knees bent to raise his legs, and an attendant can place a bedpan under the patient's upper thighs near his buttocks. The attendant can then raise the upper portion of the bed to elevate the patient's torso, bringing the patient up to a sitting position on top of the bedpan. The patient can then proceed to evacuate from this position.

DETAILED DESCRIPTION

Various embodiments of the present invention include several components: a receptacle base, forming a receptacle where fecal and urinary waste can be collected; a lid that can serve as a seat for a user of the bedpan; a disposable bag; an emplacement spatula, and a disposable bag cartridge. The lid can be hinged to the receptacle base, and can be adapted to secure the disposable bag in place to prevent its movement and the spillage of any contents. Various embodiments can also incorporate one or more locks between the lid and the receptacle base to secure the two pieces together while the bedpan is being used.

Various embodiments of the present invention incorporate a spatula that allows a single caregiver to emplace the bedpan under a user. In various embodiments, the spatula can be made from a slightly flexible plastic, a flexible metal such as thin stainless steel, or another material. Various embodiments also include a disposable bag cartridge holder, integrated in bedpan's base. Some embodiments include a bag cartridge mechanism, providing a new bag, for example dispensed from a roll.

Although parts of this disclosure present embodiments of the invention that are directed to bedpan applications for bedridden people, such as hospital or homecare patients with attending nurses or caretakers, the present invention can be used in a variety of related applications where the collection and disposal of human waste must occur without the use of a toilet. For example, variations of the present invention can be used for wheelchair bound people, and for pilots confined to a cockpit for an extended time. The direct user of the inventive bedpan will therefore variously be referred to as a "user" or a "patient" interchangeably, with the understanding that either term can refer to any user of the invention in any context for which it is applicable.

Figure 1:
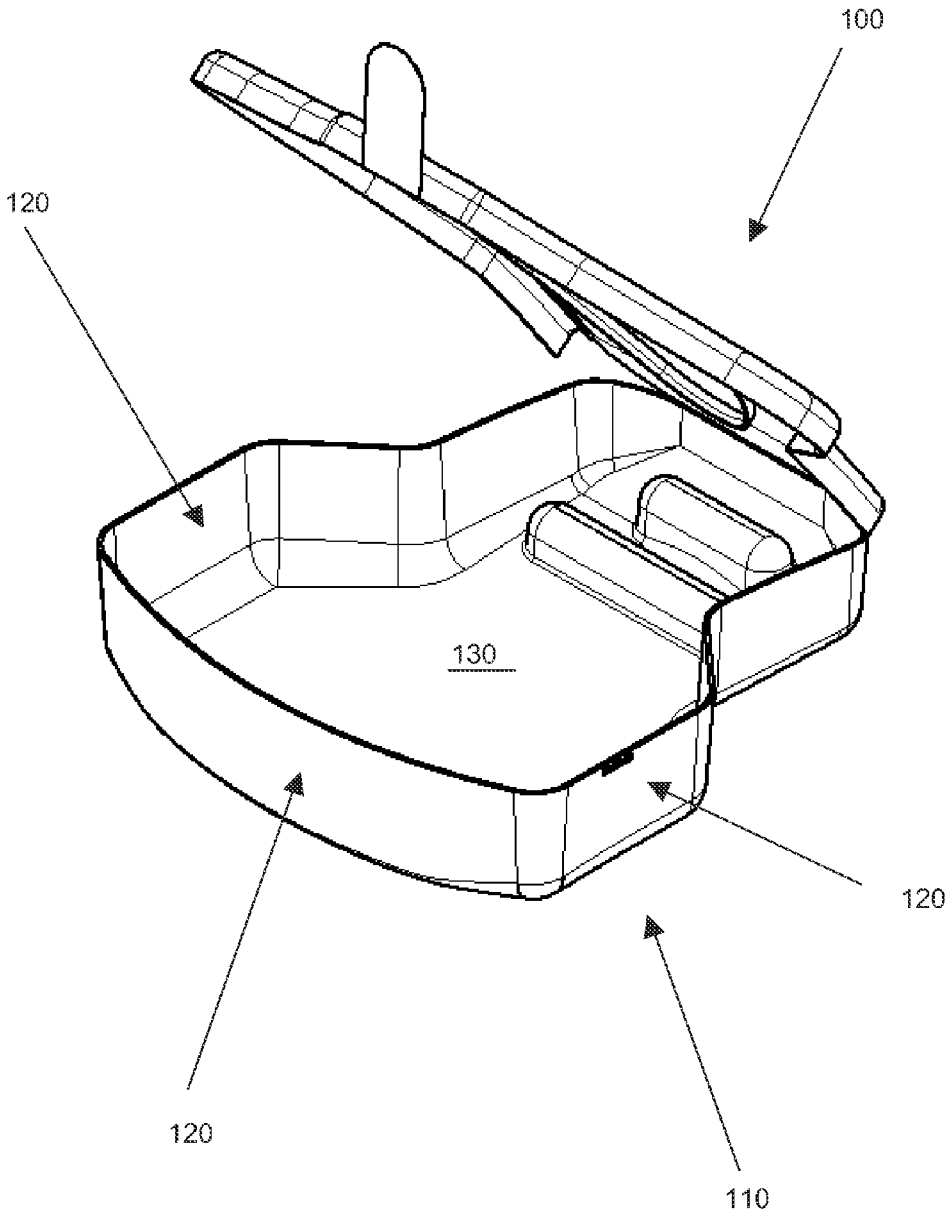
FIG. 1 is an oblique view of a bedpan according to embodiments of the present invention.

FIG. 1 illustrates an example of present bedpan, bedpan 100. Bedpan 100 has a receptacle base 110. As shown, the receptacle base can have a roughly vertical, perimeter side wall 120 and can have a floor 130, together forming a shallow basin. For example, in some embodiments, the receptacle base 110 can form a sealed basin suitable for collecting and holding liquid, such as liquid human waste. The receptacle base 110 can be a shallow basin of various shapes, with an open top. In some embodiments, the receptacle base 110 can be substantially round, oval, elliptical, rectangular, square, trapezoidal, or triangular. The receptacle base 110 can comprise a single piece or be constructed from two or more joined elements. As illustrated by bedpan 100, in various embodiments, a receptacle base 110 can be roughly configured in the shape of two rectangles of similar dimensions intersected into each other, generally forming a thick "T" shape, forming generally a basin with an open top. In various embodiments, the receptacle base 110 can be formed in a shape so as to facilitate stacking of more than one receptacle base 110 together, for example for storage or during manufacture. For example, the side wall 120 can be provided at an angle to the floor 130 so as to allow one receptacle base 110 to accommodate another within or on top of itself.

Figure 2:
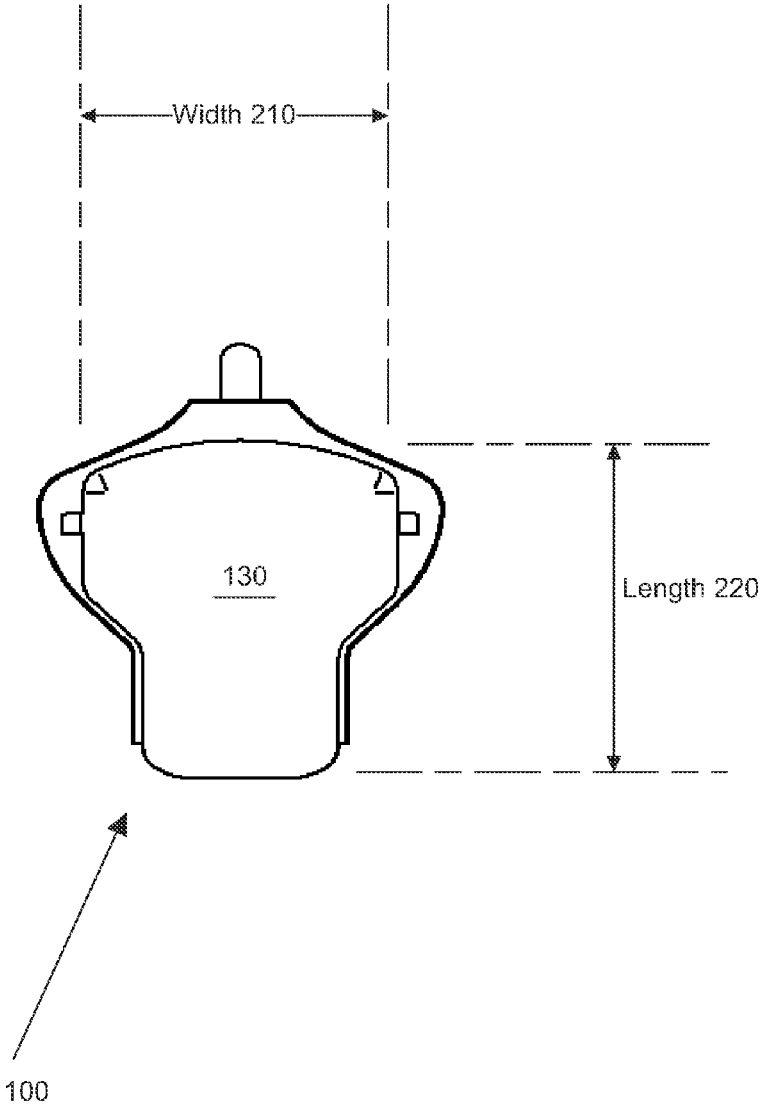
FIG. 2 is a bottom view of a bedpan according to embodiments of the present invention.

The receptacle base can have a width, length, and depth. FIG. 2 illustrates the underside of bedpan 100, with a view of the bottom of the floor 130. FIG. 2 illustrates that bedpan 100 can have a width 210 and a length 220. The length can be between 0.5 and 2.5 times the width. For example, one embodiment, the length can be between approximately 10 cm (4 in.) and 100 cm (40 in.), such as approximately 49 cm (20 in.) and the width can be between approximately 10 cm (4 in.) and 60 cm (24 in.), such as approximately 30 cm (12 in.).

Figure 3:
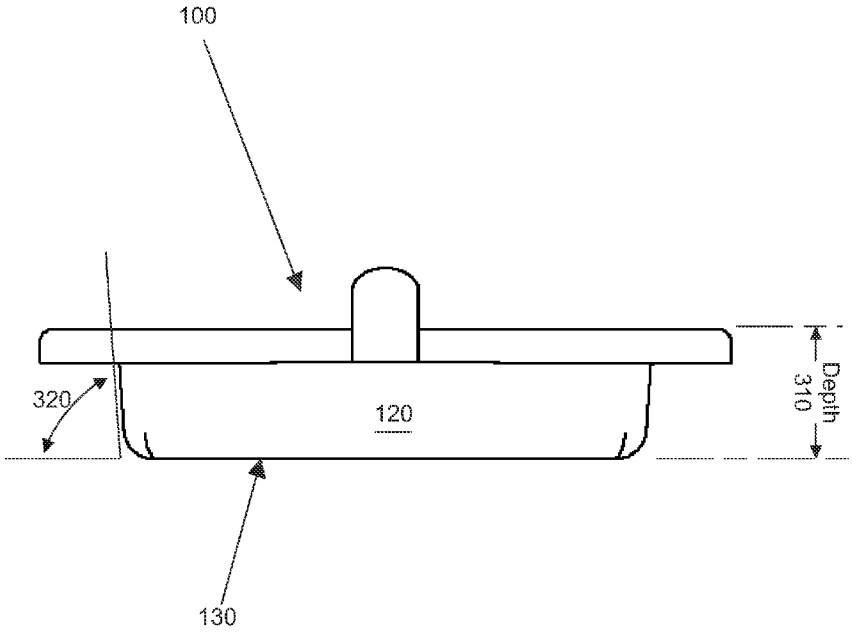
FIG. 3 is a front view of a bedpan according to embodiments of the present invention.

The receptacle base can also have a depth, which can be defined as the shortest perpendicular dimension from the underside of the exterior of the floor to the top edge of the adjacent side wall. FIG. 3 illustrates the depth 310 of bedpan 100. In some embodiments, the depth can be between approximately 1 cm (0.25 in.) and 25 cm (10 in.). The depth can be constant around the perimeter of the receptacle base or can vary around the perimeter of the receptacle base. The depth of the receptacle base can be formed from a wall that is perpendicular to the floor. As shown in FIG. 3, in some embodiments, the side wall 120 can define a side wall angle 320 relative to the floor 130 that is more or less than 90 degrees, for example between 45 and 135 degrees. In one embodiment, the perimeter wall can have an angle relative to the floor of approximately 93 to 98 degrees, for example to facilitate stacking of more than one receptacle bases together, such as to facilitate shipping, storage, or manufacture, or to facilitate mold release.

The receptacle base can be made from various suitable materials as are known in the medical device arts. The receptacle base can be made from a molded sheet of metal or plastic, can be blow molded or injection molded, can be cast or stamped, or manufactured in another way as is known. The material of the receptacle base can be substantially rigid enough to create a structurally sound bedpan capable of supporting the weight of various users weighing between approximately 20 kg (44 lb.) and 300 kg (660 lb.). Various embodiments of the present bedpan can be made of plastic such as produced with injection molding or rotomolded plastic, or can be made from stainless steel, aluminum, or another metallic material. Various embodiments of the present bedpan can be formed from transparent, translucent, or opaque material.

In some embodiments, the receptacle base can be provided with one or more locking mechanisms to facilitate secure fastening of a lid to the receptacle base. For example, in some embodiments, the locking mechanism can comprise a protrusion engagable to a latch, or a latch mechanism, such as a releasable latch mechanism as is known in the devices arts. In some embodiments, the locking mechanism can comprise a molded snap connection, such as a molded plastic catch engagable to a protrusion, or a buckle or snap, or another releasably engagable connection mechanism as is known in the lid securing arts. Various engagement mechanisms as are known can be incorporated to secure the lid to the receptacle base.

In some embodiments, a portion or all of the upper edge of the side wall can be provided with a lid joint engagement structure configured to engage a corresponding engagement structure provided on the underside of the lid, to enhance strength, rigidity, sealing, or configured to trap a part of the disposable bag in place during use. In some embodiments, the interface between the lid and the receptacle base can comprise a lid joint having a channel or groove with a corresponding ridge engagable within the channel or groove. Such a lid joint engagement structure can create a stable, rigid connection between the lid and the receptacle base, enhancing the structural strength of the bedpan in use. In various embodiments, a lid joint can further be configured to create a liquid seal between the lid and the receptacle base to prevent liquid waste within the bedpan from spilling out, for example during emplacement or removal of the bedpan from a bed or under or out from the user. For example, some embodiments can have a gasket, such as a rubber, silicone, or other flexible sealing gasket as are known in the art, in the joint between the lid and the receptacle base.

Figure 4:
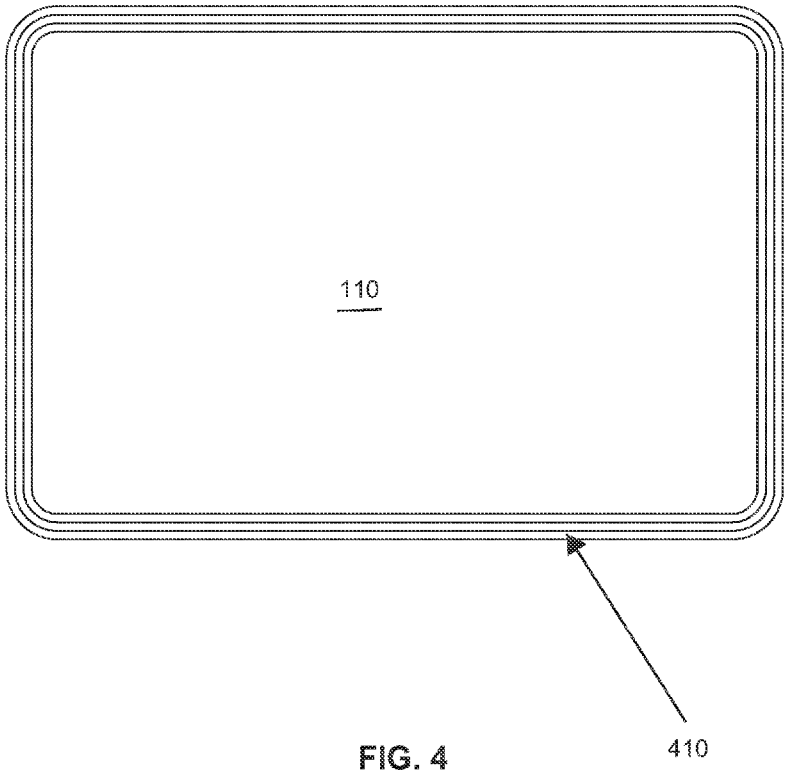
FIG. 4 is a top view of an element of a bedpan according to embodiments of the present invention.
Figure 5:
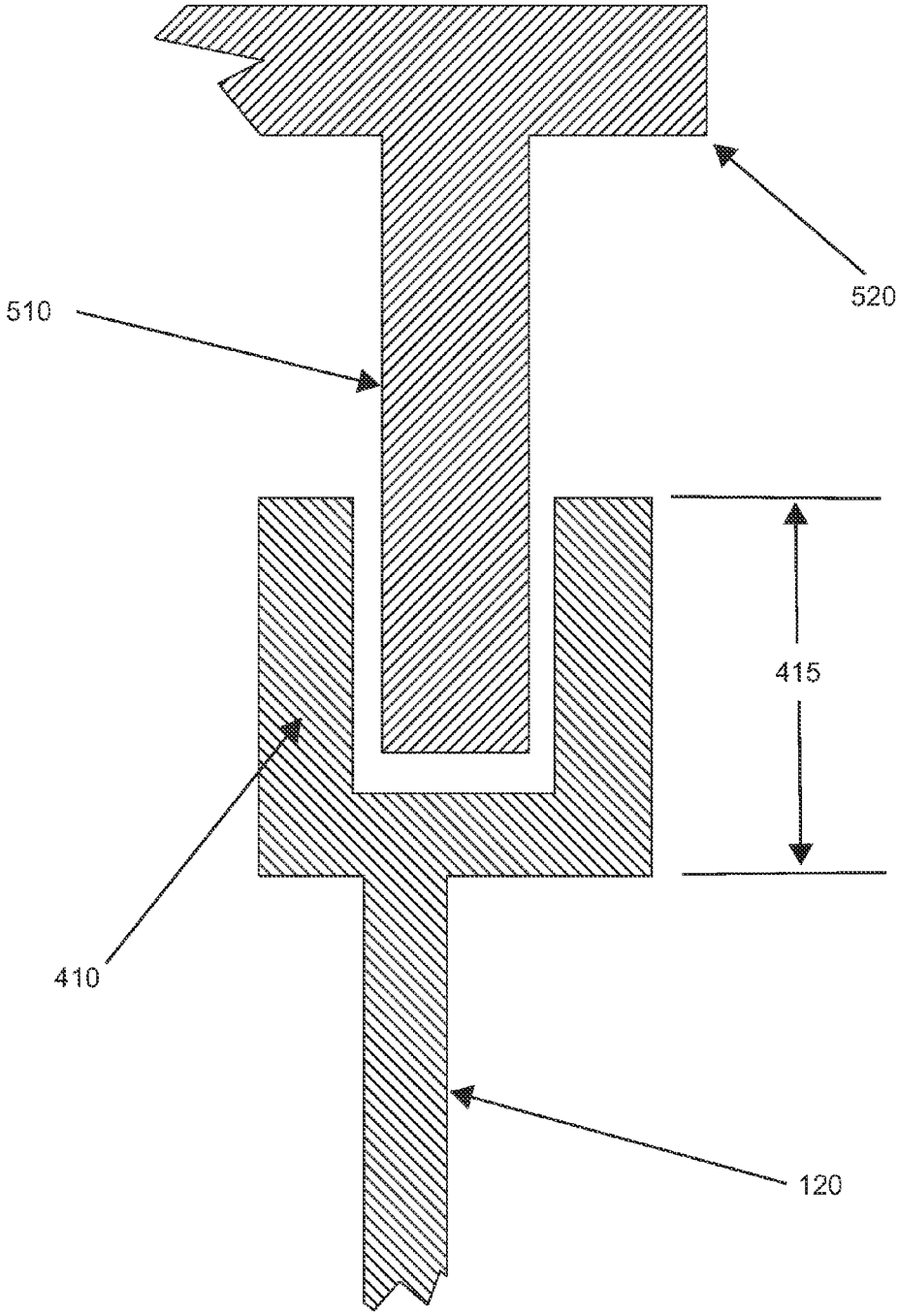
FIG. 5 is a cut-away sectional detail view of an element of a bedpan according to embodiments of the present invention.

In some embodiments, the entire upper edge of the side wall can form a channel or a ridge for engagement with an opposing ridge or channel, such as provided on a lid. In this way, the receptacle base and the lid can fit and lock together in a more hermetic and solid manner, and in some embodiments, the junction between the lid and the receptacle base can be used to fix a disposable liner and cover bag onto the bedpan. FIG. 4 illustrates a top view of receptacle base 110, showing engagement channel 410. Engagement channel 410 can receive a corresponding ridge in the lid (not shown). In various embodiments, the channel can be provided in the underside of the lid or on the top of the side wall, and the corresponding engagable ridge can be molded into the opposite corresponding lid or side wall portion. FIG. 5 illustrates a cross-sectional view of engagement channel 410 provided on the top edge of side wall 120 and ridge 510 provided on lid 520. In some embodiments, the engagement channel 410 can have a channel depth 415 between approximately 1 mm (0.1 cm, 0.04 in.) and approximately 20 mm (2 cm, 0.8 in.), such as approximately 4 mm (0.4 cm, 0.2 in.).

The underside of the lid 520 can have a channel or groove, for example along the perimeter of the underside of the lid, configured to engagably receive a corresponding ridge, to form a seal. In some embodiments, the channel can be formed from two parallel, longitudinal ridges disposed a distance from each other along their length. The channel can be configured to engage a corresponding ridge, for example provided on the receptacle base, such as disposed on the side walls of the receptacle base and configured to fit within the channel. Such a design makes the base and the lid, fit and lock together in a more hermetic and solid manner and can further serve to secure the disposable bag in use.

Various embodiments of the receptacle base can have a lug or catch configured to secure a disposable bag in place. In some embodiments, the lug or catch can be the locking mechanism, and the locking mechanism can be configured to secure the disposable bag to the bedpan to prevent shifting or slipping of the disposable bag within the bedpan.

Figure 6:
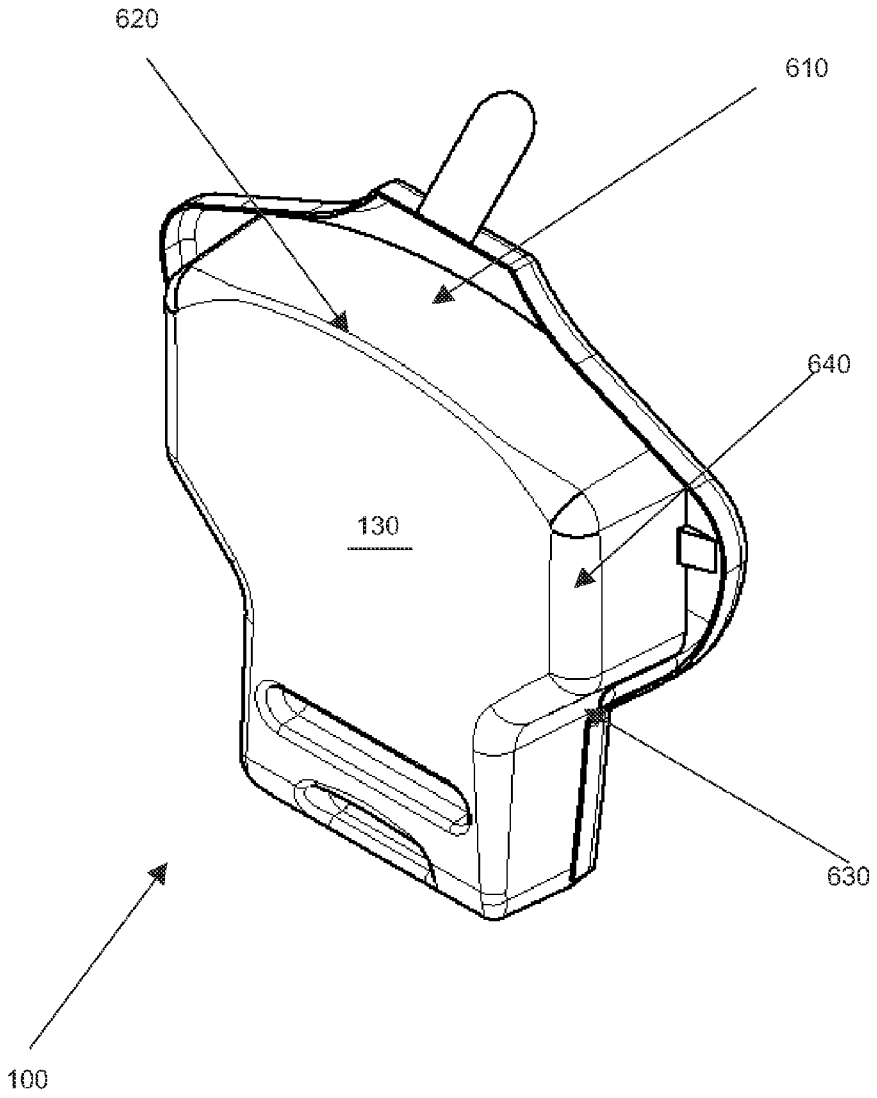
FIG. 6 is a bottom oblique view of a bedpan according to embodiments of the present invention.

The receptacle base can have a proximal side wall coupled to the floor of the basin, which proximal side wall is configured to be oriented, in use, closest to the user's buttocks during emplacement of the bedpan under the user. FIG. 6 illustrates bedpan 100, showing the underside of floor 130. FIG. 6 shows proximal wall 610. The proximal side wall 610 can intersect the floor 130 at a proximal intersection 620 that can have a proximal intersection curvature with a radius, for example a radius of between 0.5 mm to 3 cm. In various embodiments, the proximal intersection curvature can form a sharp intersection to prevent slipping of the bedpan out from under the user when the bedpan is angled up and under the user when the bed upper section is raised up. For example, in some embodiments, in use the bedpan proximal intersection 620 can be positioned to engage the articulation point of a bed, such as an electrically reclinable bed like a hospital bed, to retain the bedpan in the proper orientation under the user while the upper portion of the bed is being raised up. This can be done to position the user over the bedpan in a sitting position on top of the bedpan.

In various embodiments, the bedpan can have lateral side walls adjacent to the proximal side wall and joined to the basin floor along a lateral side wall intersection. FIG. 6 shows lateral side wall 630 and lateral side wall intersection 640. The lateral side wall intersection 640 can have a lateral side wall intersection curvature, and the lateral side wall intersection curvature can have a lateral side wall intersection curvature radius, such as between approximately 1 cm (0.4 in.) and 5 cm (2 in.), for example approximately 2 cm (0.8 in.). The lateral side wall intersection curvature radius can be large enough to facilitate the lateral sliding of the bedpan 100, for example under blankets and over sheets and under pajamas or hospital gowns or other clothes, in order to facilitate the emplacement of the bedpan 100 under the user, for example by an attendant.

Figure 7:
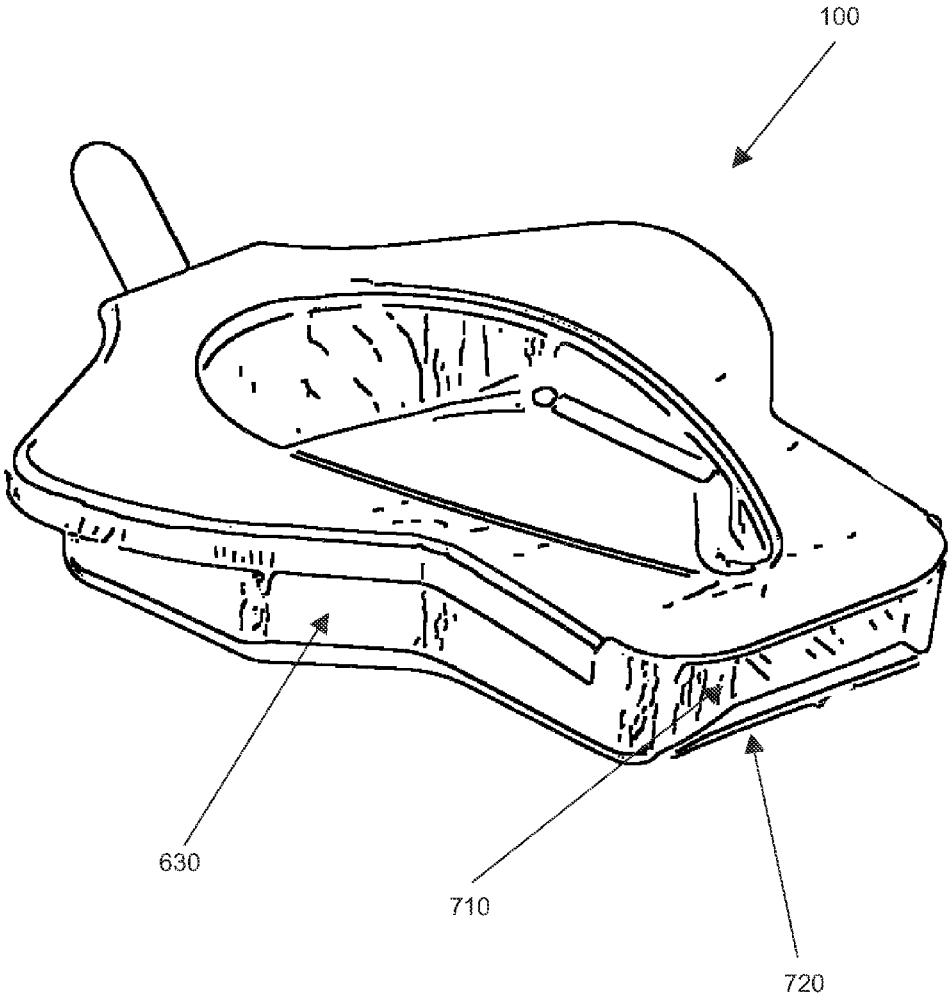
FIG. 7 is a top oblique view of a bedpan according to embodiments of the present invention.

FIG. 7 shows bedpan 100. FIG. 7 illustrates inventive bedpan 100 can have a distal side wall 710 adjacent to the lateral side wall 630, opposite the proximal side wall (not shown), and joined to the floor (not shown) at a distal side wall intersection 720. Distal side wall intersection 720 can have a distal side wall intersection curvature, and the distal side wall intersection curvature can have a distal side wall intersection curvature radius, such as between approximately 1 cm (0.4 in.) and 5 cm (0.2 in.), such as approximately 3 cm (1.2 in.). The distal side wall intersection curvature radius can be large enough to facilitate the sliding of the bedpan 100, for example under blankets and over sheets and under pajamas or hospital gowns or other clothes, in order to facilitate the emplacement of the bedpan 100 under the user, for example by an attendant.

Various embodiments of the receptacle base can have structural supports, such as molded supports, incorporated into the form of the receptacle base, such as molded into the side walls, to provide structural support to the bedpan under compressive loads, such as will be encountered when in use, particularly with large, overweight or obese users. Structural supports can comprise columns, such as tubular, square, or cruciform reinforcement columns, to provide compression resistance. Some embodiments can have four vertical columns molded into the side wall of the bedpan to increase strength and capability to resist overweight users without having to increase thickness of the side wall, thereby saving material and keeping bedpan weight as low as possible.

Some embodiments can incorporate vertical columns provided on the floor of the receptacle base and extending upward into the interior of the basin portion of the receptacle base, having a freestanding end opposite a base end joined to the floor of the receptacle base. In such embodiments, the freestanding end can be configured to engage or but against the underside surface of the lid, such as against an engagement support pad to distribute stress, to further provide compression resistance and enhance the structural integrity of the bedpan.

Figure 8:
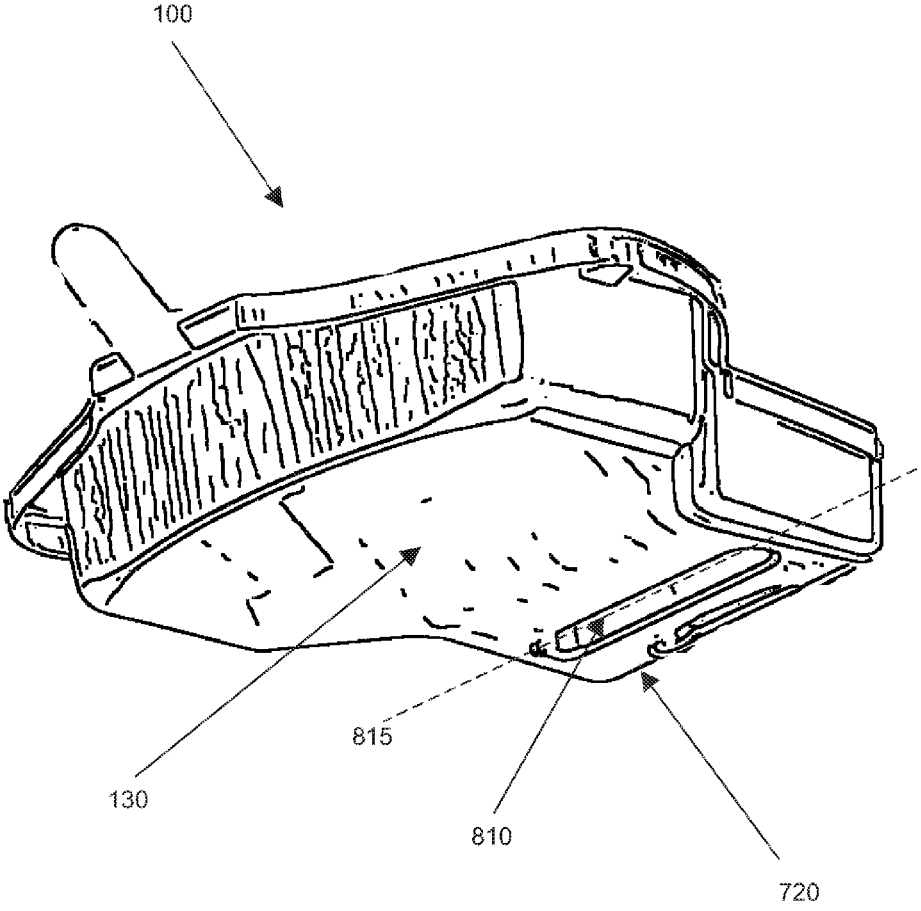
FIG. 8 is a bottom oblique view of a bedpan according to embodiments of the present invention.
Figure 9:
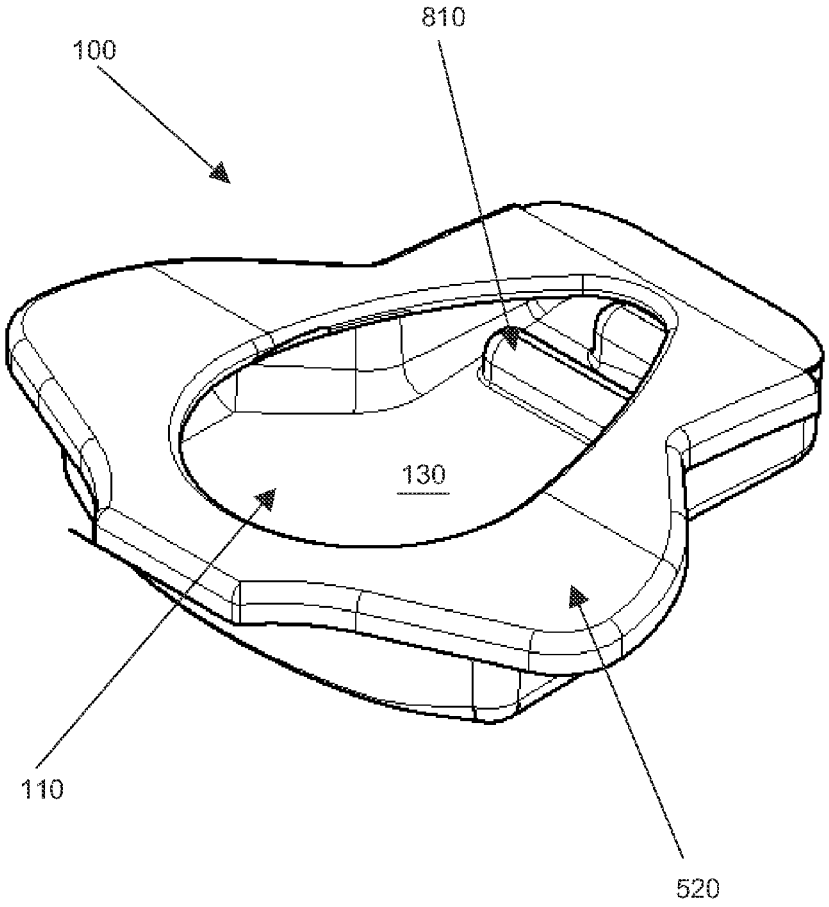
FIG. 9 is a top oblique view of a bedpan according to embodiments of the present invention.

In various embodiments of the present bedpan invention, the floor of the receptacle base can have a disposable bag cartridge recess to accommodate and receive a disposable bag cartridge. FIG. 8 shows bedpan 100 and floor 130. FIG. 8 shows bedpan 100 can have disposable bag cartridge recess 810. In various embodiments, the disposable bag cartridge recess 810 can be provided in the receptacle base floor 130, for example approximately 4 cm (1.6 in.) away from the distal side wall intersection 720. In one embodiment, the disposable bag cartridge recess 810 can be a rectangular cavity that is approximately 12 cm (5 in.) long by 3 cm (1.2 in.) wide, and can have a depth of approximately 5 cm (2 in.), and can be oriented with its longitudinal axis 815 parallel to the distal side wall intersection 720. The disposable bag cartridge recess 810 can receive and retain a disposable bag cartridge (not shown), for example by one or more fixed supports (not shown), and in some embodiments, a locking mechanism (not shown) to securely retain a disposable bag cartridge within the bag cartridge recess 810. In various embodiments, the disposable bag cartridge recess 810 can be provided in the lid of the bedpan, or in the receptacle base, or in both. In various embodiments, the disposable bag cartridge recess 810 can have a tear off element, such as a sharp element, hook, or prong, configured to facilitate the dispensing and tearing off of one disposable bag from a disposable bag cartridge at a time. FIG. 9A shows bedpan 100, showing lid 520 and the interior of receptacle base 110. FIG. 9A shows disposable bag cartridge recess 810 viewed from the inside of receptacle base 110, showing that disposable bag cartridge recess 810 can be provided in floor 130, for example molded in floor 130. The disposable bag cartridge can have several disposable bags in a compact configuration to facilitate storage and dispensing them therefrom, for example in a roll. For example, in some embodiments, the disposable bag cartridge can be a roll of disposable bags, each separated by perforations for ease of separation of the bags in each use, as is known in the plastic bag dispensing arts. The supports and optional lock provided in a disposable bag recess can be configured to allow the disposable bag cartridge to roll when a new bag is required and pulled out, but also to retain the cartridge to keep the disposable bag fixed while bedpan is being used. The disposable bag cartridge can be replaceable.

The disposable bag cartridge can store disposable bags for use in various embodiments of the present inventive bedpan. In various embodiments, the disposable bag cartridge can comprise a carton or plastic cylinder where several, such as between two and 1000, for example approximately 20, disposable bags are stored, such as rolled up in a roll. The disposable bag cartridge can be retained in place in a recess by various mechanisms as are known in the rolled material arts.

In some embodiments, the disposable bag can serve as a disposable reservoir to receive and contain human waste in a safe and hygienic manner and facilitate its disposal. The disposable bag can also serve as a cover for the entire bedpan to avoid physical contact between bedpan and user in order to avoid the need to clean the bedpan after every use. Therefore, in various embodiments, a flexible disposable bag can be used to capture and catch all the fecal and urinary matter and at the same time cover the whole exterior of the bedpan device, avoiding direct contact between the user and the device for hygienic purposes.

In various embodiments, the disposable bag can have dimensions to enable covering the bedpan exterior and lining the bedpan interior at the same time. For example, in use, the disposable bag can be dispensed from a disposable bag cartridge, drawn over the bedpan to cover the entire bedpan, and pushed into the interior of the bedpan, for example through the orifice in the lid, to line the interior of the receptacle base of the bedpan to capture the human waste deposited therein by the user of the device. A portion of the disposable bag can be pushed into the interior of the receptacle base basin, for example through the orifice in the lid of the bedpan through which the user may defecate and urinate. A portion of the disposable bag may be pushed into the interior of the receptacle base for example by an attendant, a nurse, or by the user himself. In various embodiments, the disposable bag can be secured in place by opening the lid, for example by creating a separation between the lid and the receptacle base, and then pushing part of the disposable bag into the open joint between the lid and the receptacle base, and then closing and securing the lid over the receptacle base, trapping the disposable bag in place within the bedpan.

In various embodiments, the lid joint can incorporate one or more locking mechanisms to ensure that the lid is securely attached to the receptacle base. Some embodiments do not use a latch or lock mechanism to secure the lid onto the receptacle base. In such embodiments, the lid can fit onto the receptacle base loosely or snugly, and in use, can be held in place by virtue of the weight of the user.

Various embodiments of the inventive bedpan incorporate handholds, such as molded lugs or molded recesses, to facilitate gripping and manipulating the bedpan during use. In various examples, the handholds can comprise a recess molded in a portion of the bedpan, for example into the receptacle base, such as in the floor, in the form of a recess designed to accommodate the tips of the fingers of an attendant. For example, the handholds can be provided on the floor of the bedpan, such as alongside and near a side wall intersection. In one embodiment, such a handhold lug is provided in between a disposable bag cartridge recess and the distal side wall.

Figure 10:
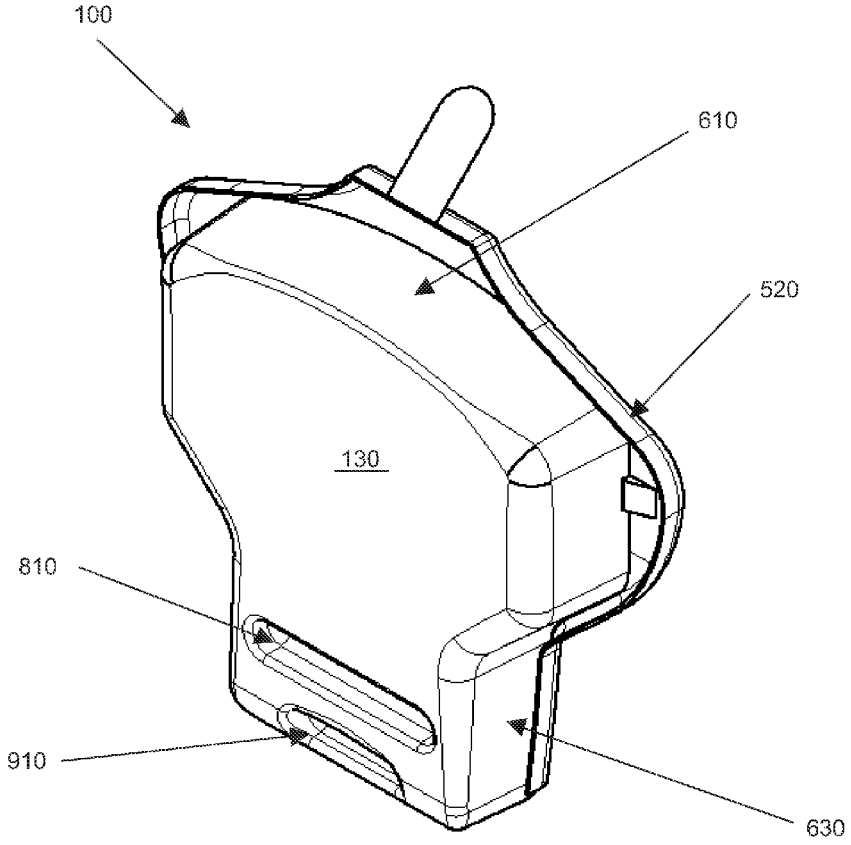
FIG. 10 is a bottom oblique view of a bedpan according to embodiments of the present invention.
Figure 11:
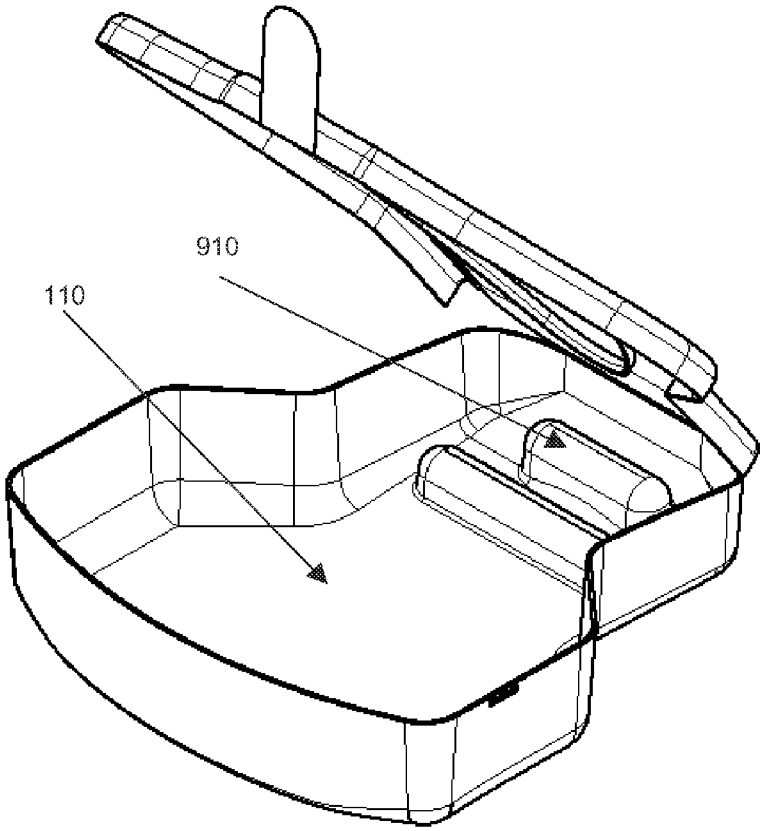
FIG. 11 is a top oblique view of a bedpan according to embodiments of the present invention.
Figure 12:
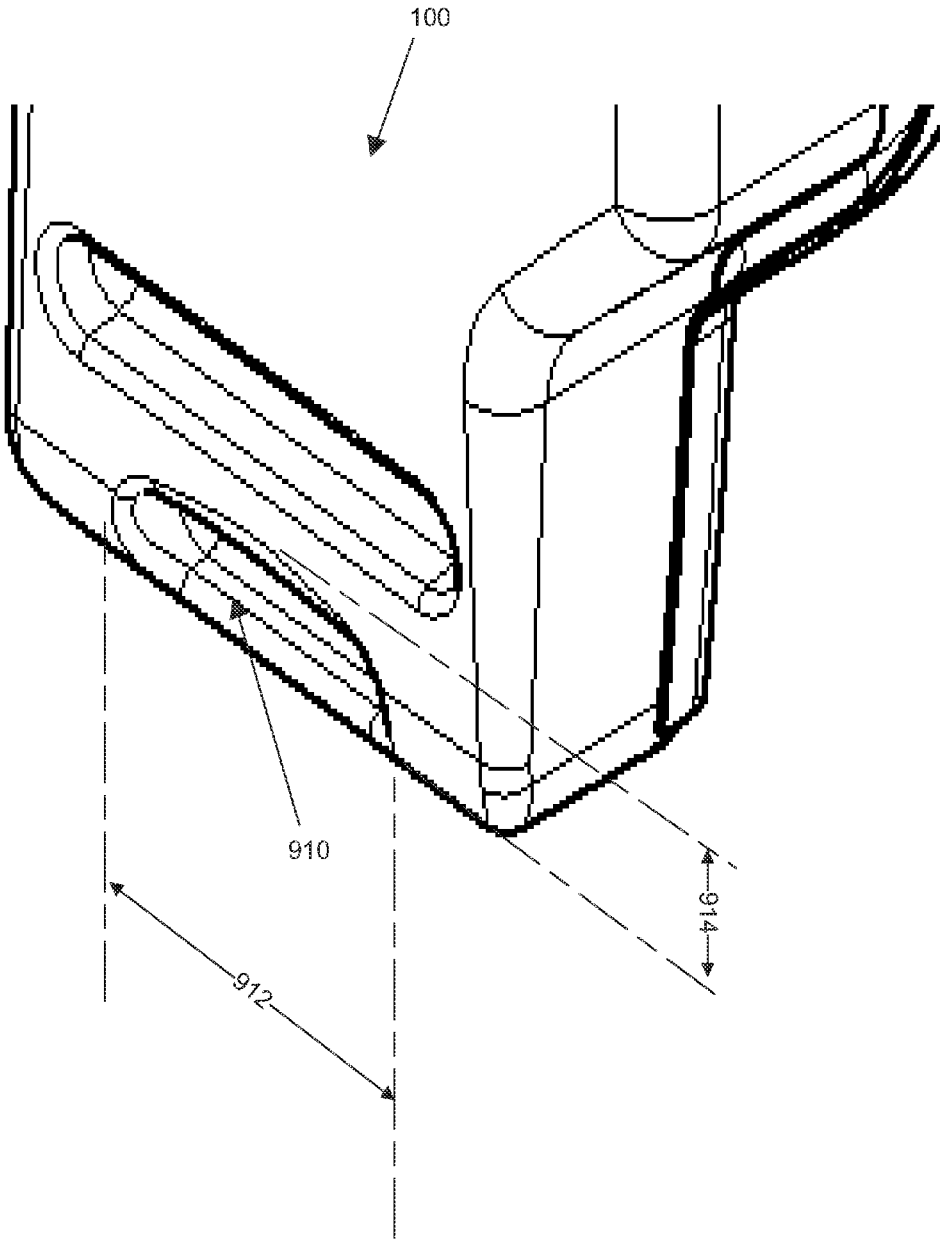
FIG. 12 is a bottom oblique detail view of a bedpan according to embodiments of the present invention.
Figure 13:
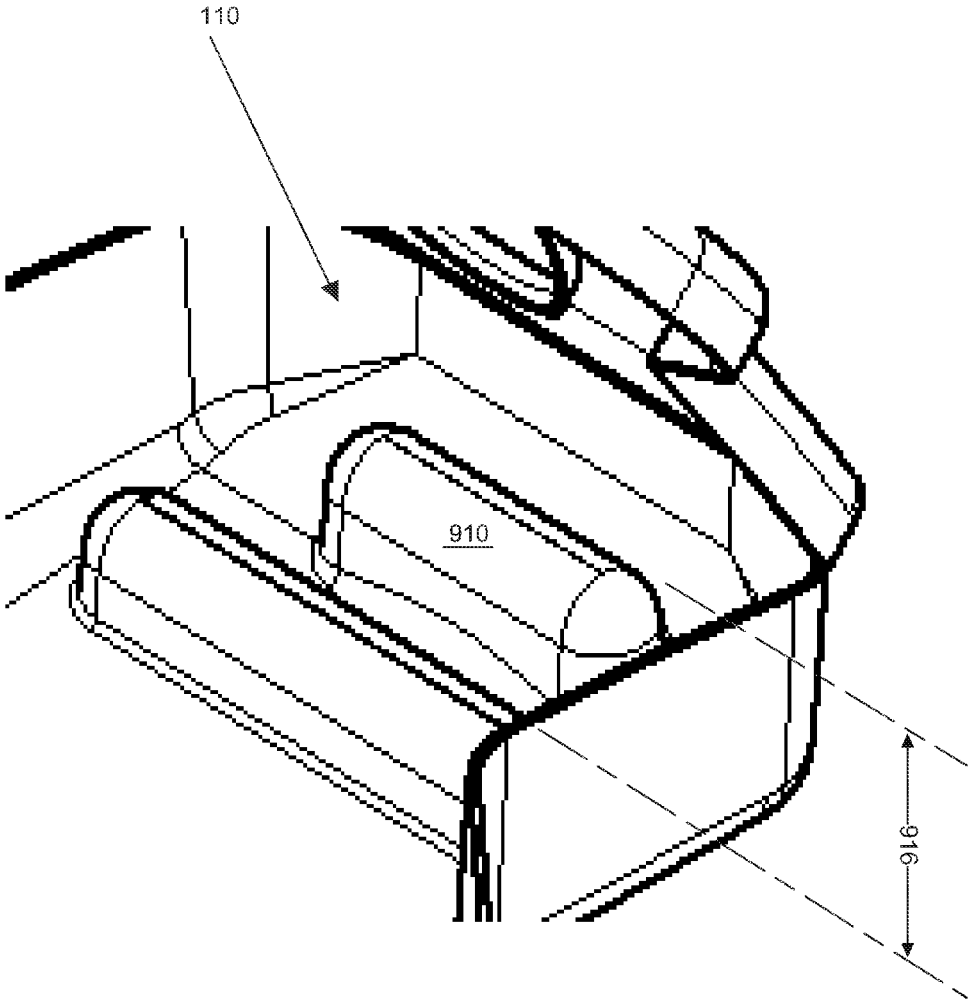
FIG. 13 is a top oblique detail view of a bedpan according to embodiments of the present invention.

FIG. 10 shows bedpan 100 having handhold 910 in floor 130 adjacent to disposable bag cartridge recess 810. In some embodiments, handhold 910 can be provided anywhere in the receptacle base 110 such as anywhere in floor 130 of bedpan 100, including adjacent to a lateral side wall 630, adjacent to the distal side wall, adjacent to the proximal side wall 610, in a lateral side wall 630, in the proximal side wall 610, in the distal side wall, or in lid 520. FIG. 11 shows handhold 910 viewed from the inside of the receptacle base 110. FIG. 12 shows a detail view of handhold 910 viewed from the underside of bedpan 100. Handhold 910 has a handhold length 912 of approximately 9 cm (3.6 in.) and a handhold width 914 of approximately 4 cm (1.6 in.). Handhold 910 has a handhold depth 916 of approximately 3 cm (1.2 in.). In various embodiments, handhold 910 can have a handhold length 912 of between approximately 2 cm (0.8 in.) and 30 cm (12 in.), and can have a handhold width 914 of between approximately 2 cm (0.8 in.) and 10 cm (4 in.). FIG. 13 shows a detail view of handhold 910 viewed from the inside of receptacle base 110. In various embodiments, handhold 910 can have a handhold depth 916 of between approximately 1 cm (0.4 in.) and 10 cm (4 in.), such as approximately 4 cm (1.6 in.).

Figure 14:
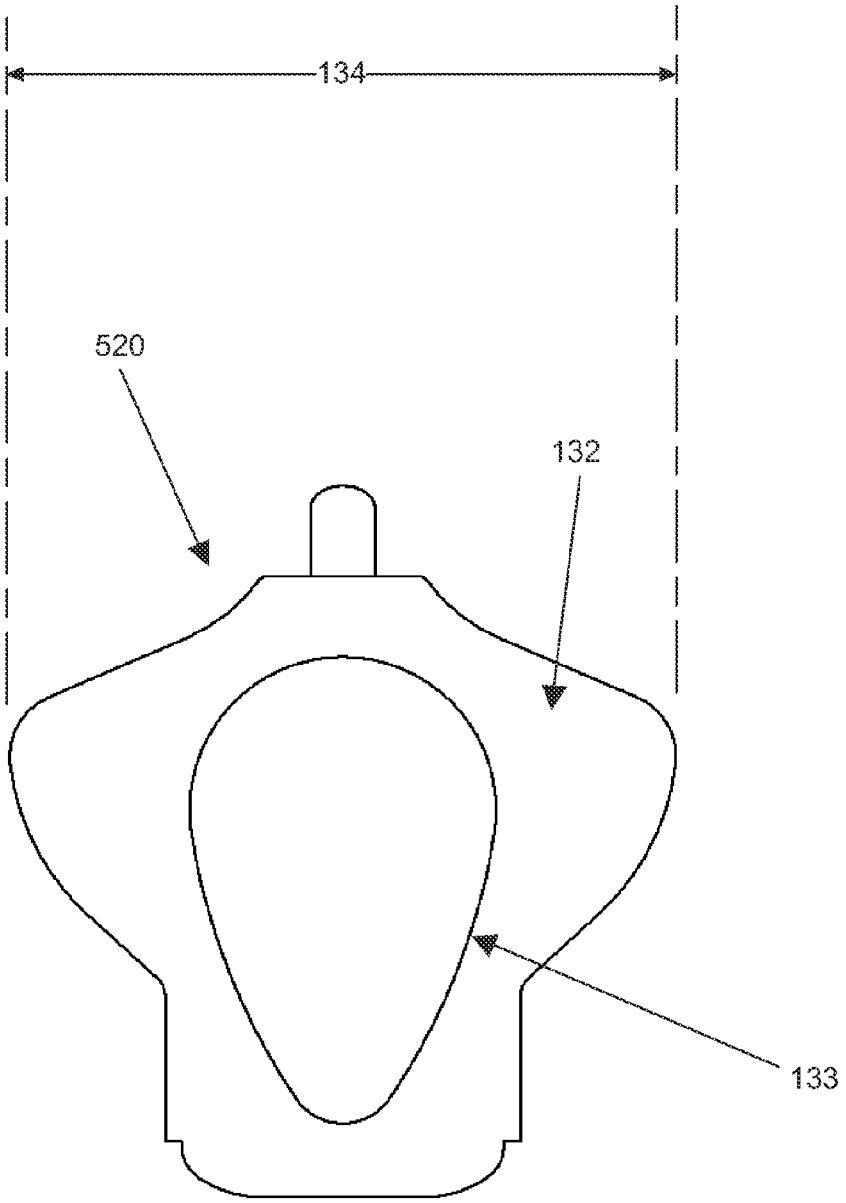
FIG. 14 is a top view of a bedpan according to embodiments of the present invention.

Several embodiments of the present invention can have a lid configured to fit over and cover the receptacle base. FIG. 14 shows a top view of lid 520. In various embodiments, the lid can have an upper surface 132 and an underside (not shown) opposite the upper surface. The upper surface can be configured to form a comfortable seating portion, similar in contour to a toilet seat, to comfortably accommodate the buttocks of a user. The lid can be provided with an aperture or orifice 133 therethrough, through which the user can defecate and urinate into the receptacle base. The orifice 133 can describe an oval or round shape aperture, or an elliptical hole roughly in the center of the lid. Lid 520 can have a width 134. Some embodiments can have a lid with a width that is wide enough to accommodate large, overweight, and obese users comfortably and safely, such as between 60 cm (24 in.) and 140 cm (56 in.), such as approximately 75 cm (30 in.). In various embodiments, the lid can be made from the same material as the receptacle base or from another suitable material as is known in the bedpan arts. In various embodiments, the lid can be formed in such a manner so as to facilitate stacking of more than one lid on top of each other, for example for storage or during manufacture.

Figure 15:
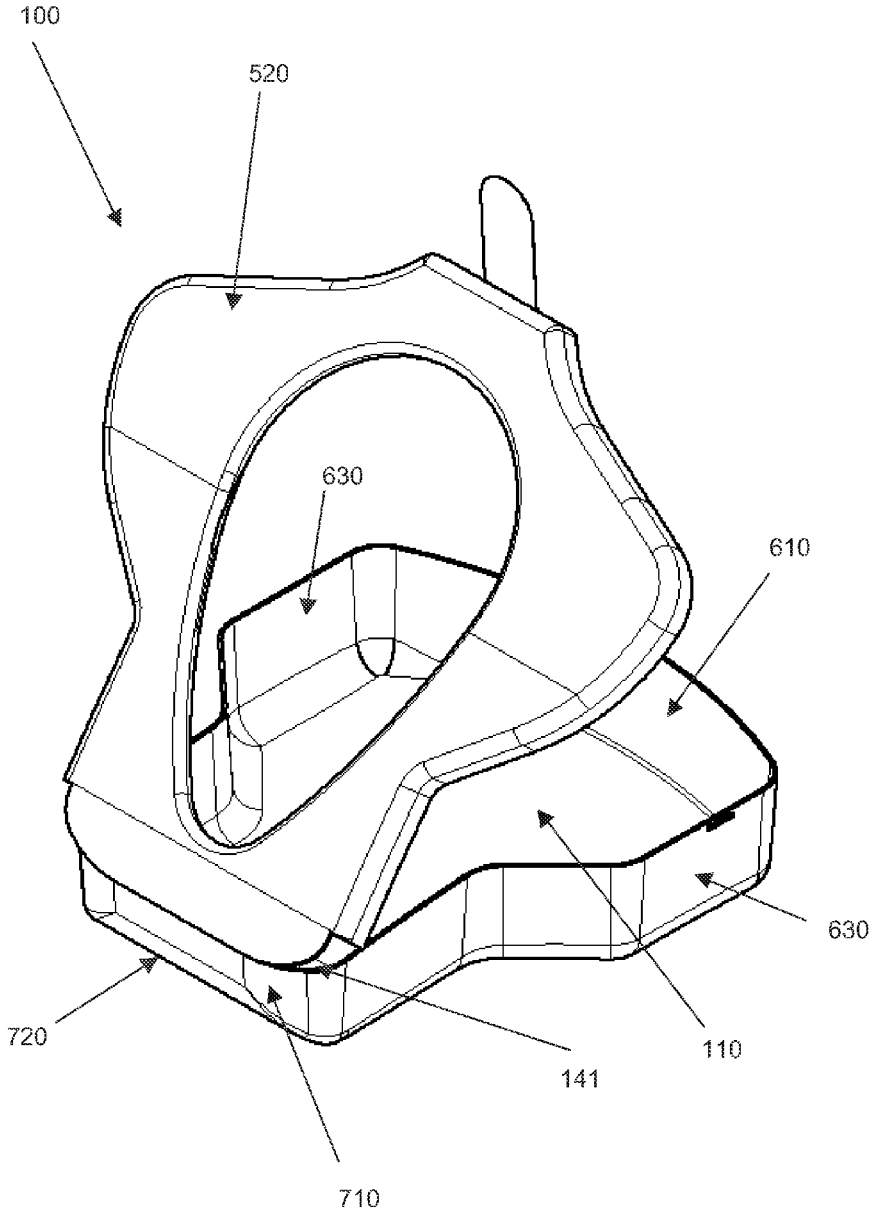
FIG. 15 is a top oblique view of a bedpan according to embodiments of the present invention.
Figure 16:
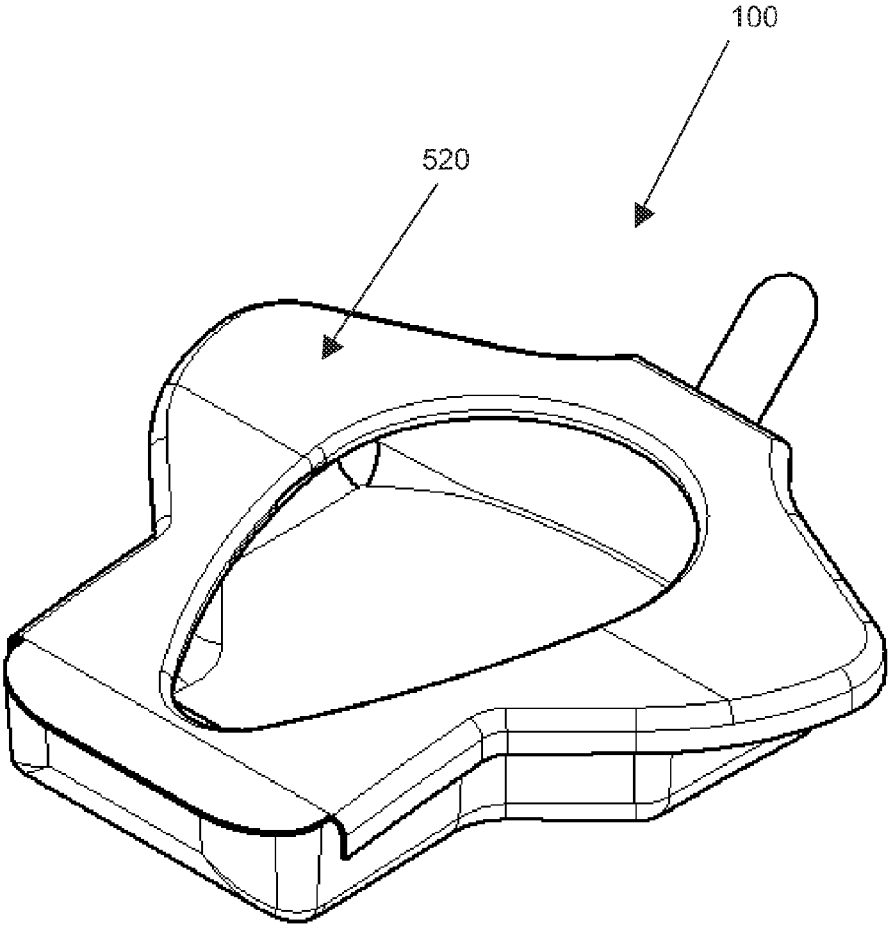
FIG. 16 is a top oblique detail view of a bedpan according to embodiments of the present invention.

FIG. 15 shows bedpan 100 with lid 520 and receptacle base 110. The lid 520 can be entirely removable from the receptacle base 110, or can be hinged to the receptacle base, for example by a hinge provided on a side wall, for example near the edge of the distal side wall opposite the distal side wall intersection 720. FIG. 15 shows hinge 141 on distal side wall 710. The hinge 141 allows fixing the lid 520 to the bedpan 100 while giving the lid 520 mobility to be lifted and opened by the end opposite to the hinge 141. FIG. 15 shows lid 520 in an open configuration. In various embodiments, the hinge 141 can be provided on one of the lateral side walls 630 of the bedpan and couple to the lid 520 under one of the lateral edges or lips of the lid 520. The lid 520 can be hinged along any of the side walls, such as near the upper edge of the proximal side wall 610. FIG. 16 shows bedpan 100 with the lid 520 in a closed configuration.

Figure 17:
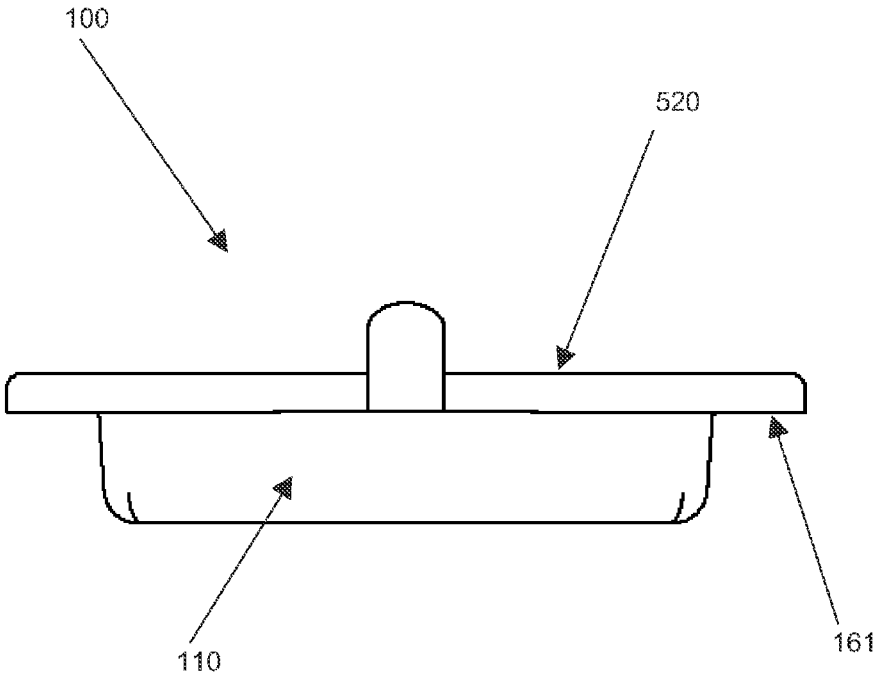
FIG. 17 is a front view of a bedpan according to embodiments of the present invention.
Figure 18:
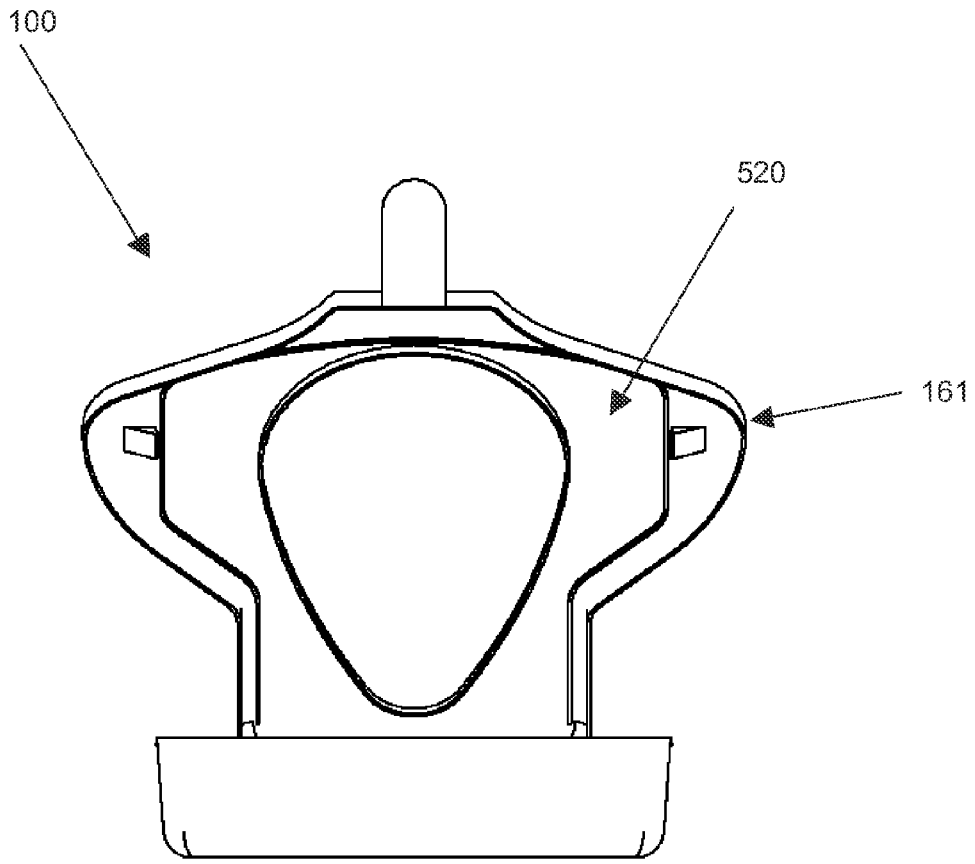
FIG. 18 is a front view of a bedpan according to embodiments of the present invention.
Figure 19:
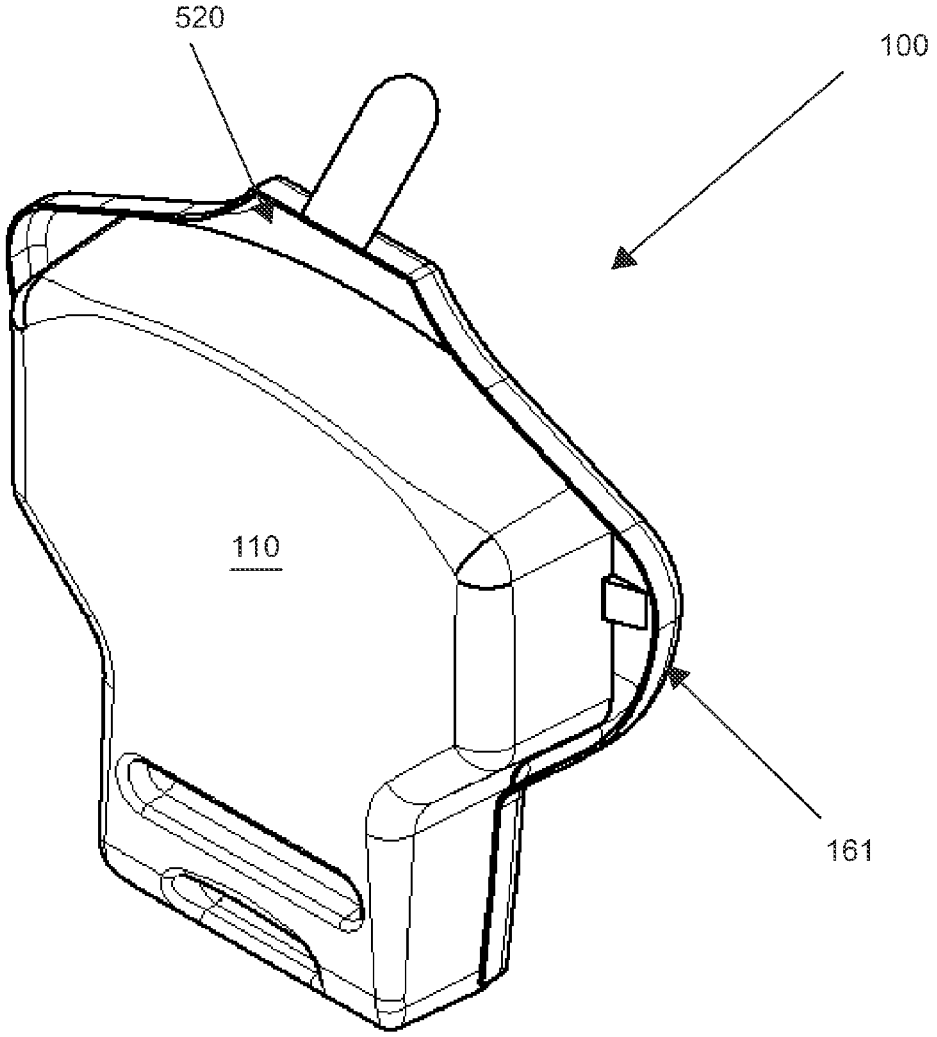
FIG. 19 is a bottom oblique view of a bedpan according to embodiments of the present invention.

In some embodiments, the outer perimeter of the lid can be turned down away from the upper portion, for example to form a lip, which in some embodiments can be configured to facilitate gripping by an attendant by curling the attendant's fingers under the lip, for example to facilitate manipulation of the bedpan. FIG. 17 shows a view of the proximal end of bedpan 100 having lid 520 on receptacle base 110. FIG. 17 shows lid 520 has a lip 161. FIG. 18 shows bedpan 100 having lid 520 in an open configuration showing lip 161. FIG. 19 shows the underside of bedpan 100 showing receptacle base 110 and the lip 161 of lid 520.

Various embodiments of lids incorporate a locking mechanism disposed on the underside of the lid and configured to engage a corresponding element provided on the receptacle base. In various embodiments, the locking mechanism can comprise a protrusion, for example a protrusion provided on the underside of the lid near the distal portion of the lid. In various embodiments, one locking mechanism can be provided, such as opposite a hinge, to engage a corresponding element on the distal side wall. In some embodiments, two locking mechanisms can be provided, for example on the lateral sides of underside of the lid, for example configured to engage corresponding elements provided on the vertical lateral walls of the receptacle base. In various embodiments, three or more locking mechanisms may be used. In other embodiments, no locking mechanisms are used.

Figure 20:
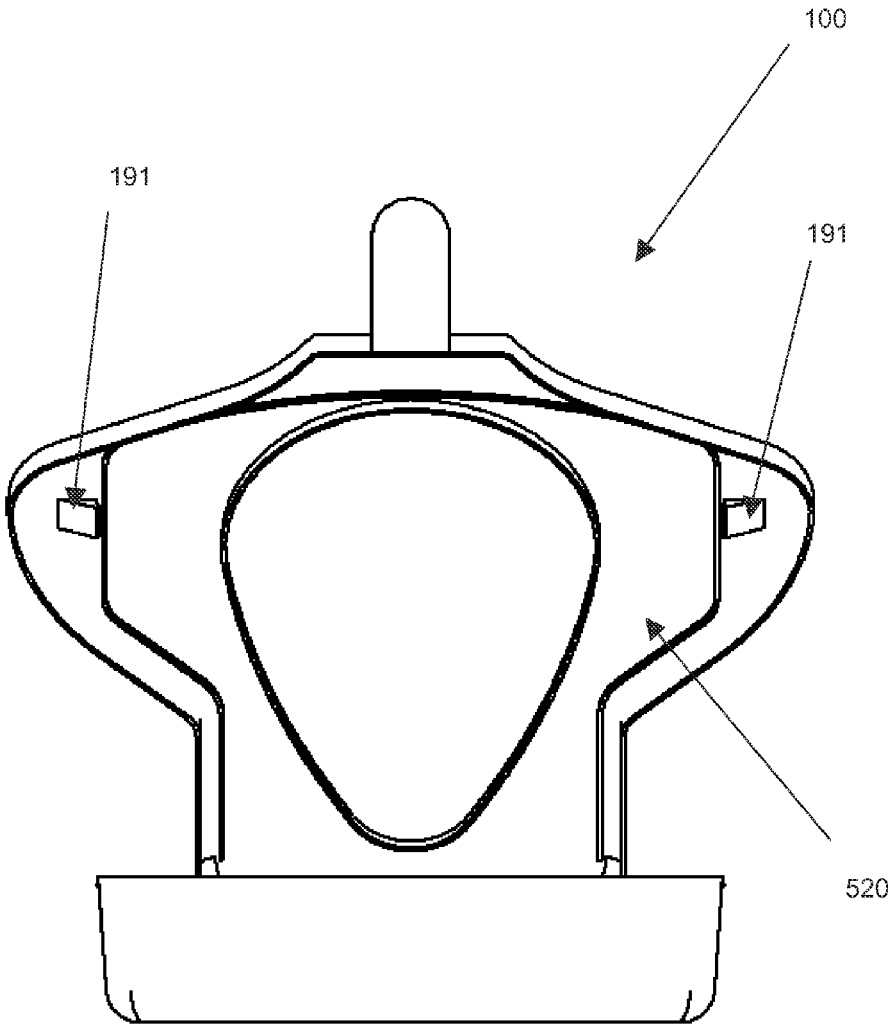
FIG. 20 is a front view of a bedpan according to embodiments of the present invention.
Figure 21:
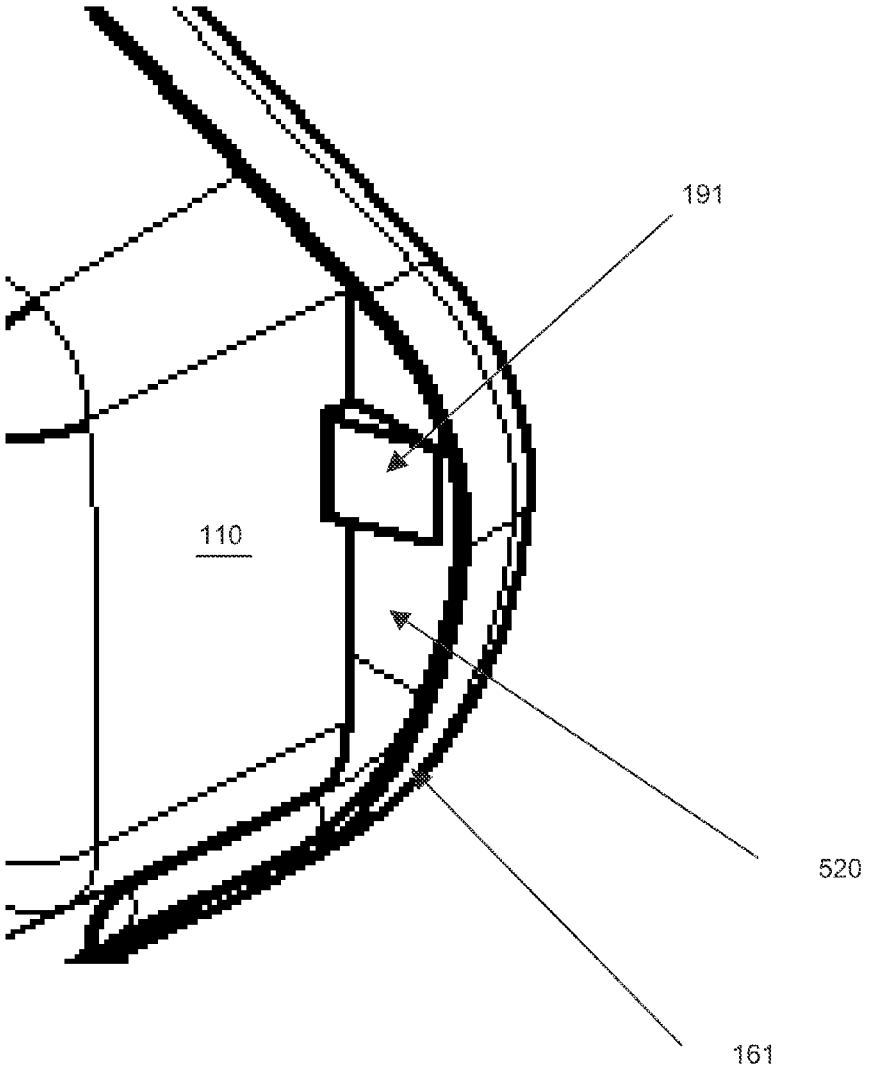
FIG. 21 is a bottom oblique detail view of a bedpan according to embodiments of the present invention.
Figure 22:
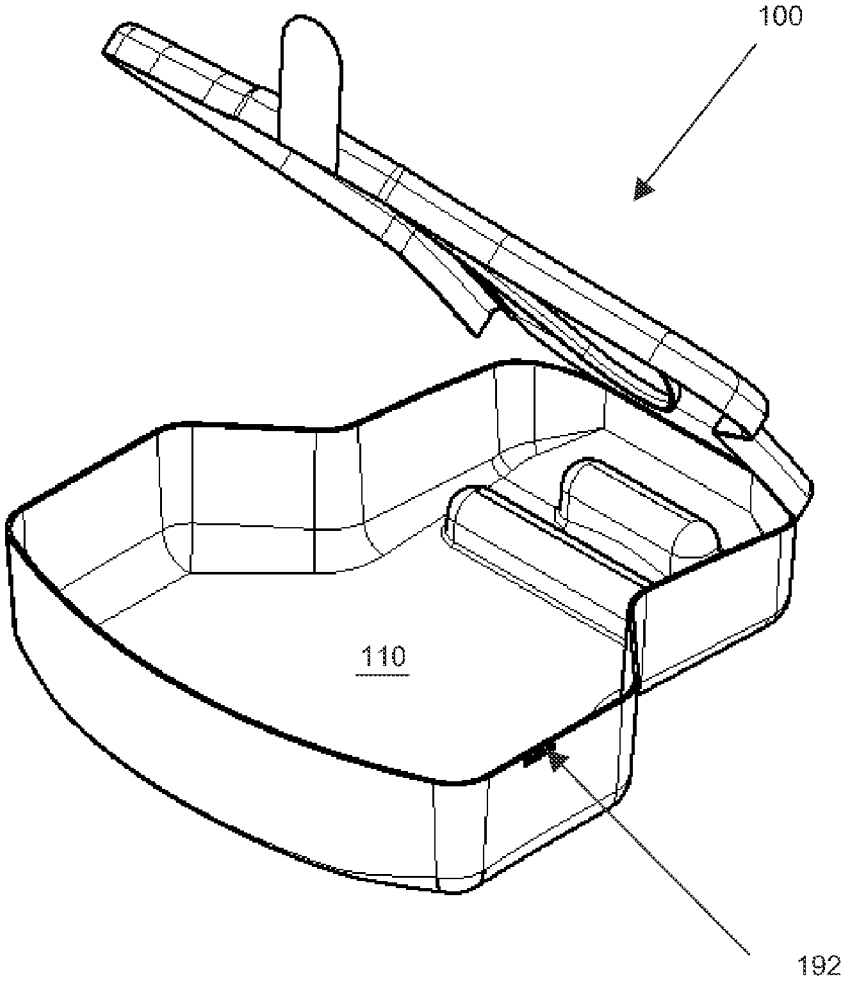
FIG. 22 is a top oblique view of a bedpan according to embodiments of the present invention.

FIG. 20 shows bedpan 100 with lid 520 in an open configuration. FIG. 20 shows bedpan 100 and shows the underside of lid 520, and shows clips 191, forming one part of a two part locking mechanism and disposed on the underside of lid 520. The two part locking mechanism has a clip 191 that releasably engages a corresponding catch (not visible) disposed on the receptacle base 110. FIG. 21 shows a detail view of clip 191 disposed on the underside of lid 520. Lid 520 has a lip 161. FIG. 21 shows clip 191 engaged to catch 192 (not visible) to close lid 520 onto receptacle base 110. FIG. 22 shows bedpan 100 and shows catch 192 disposed on a side wall of receptacle base 110. In various embodiments, locking mechanisms may be catches, latches, buckles, snaps, magnets, clasps, clutches, molded catches, or other securing mechanisms as are well known.

Figure 23:
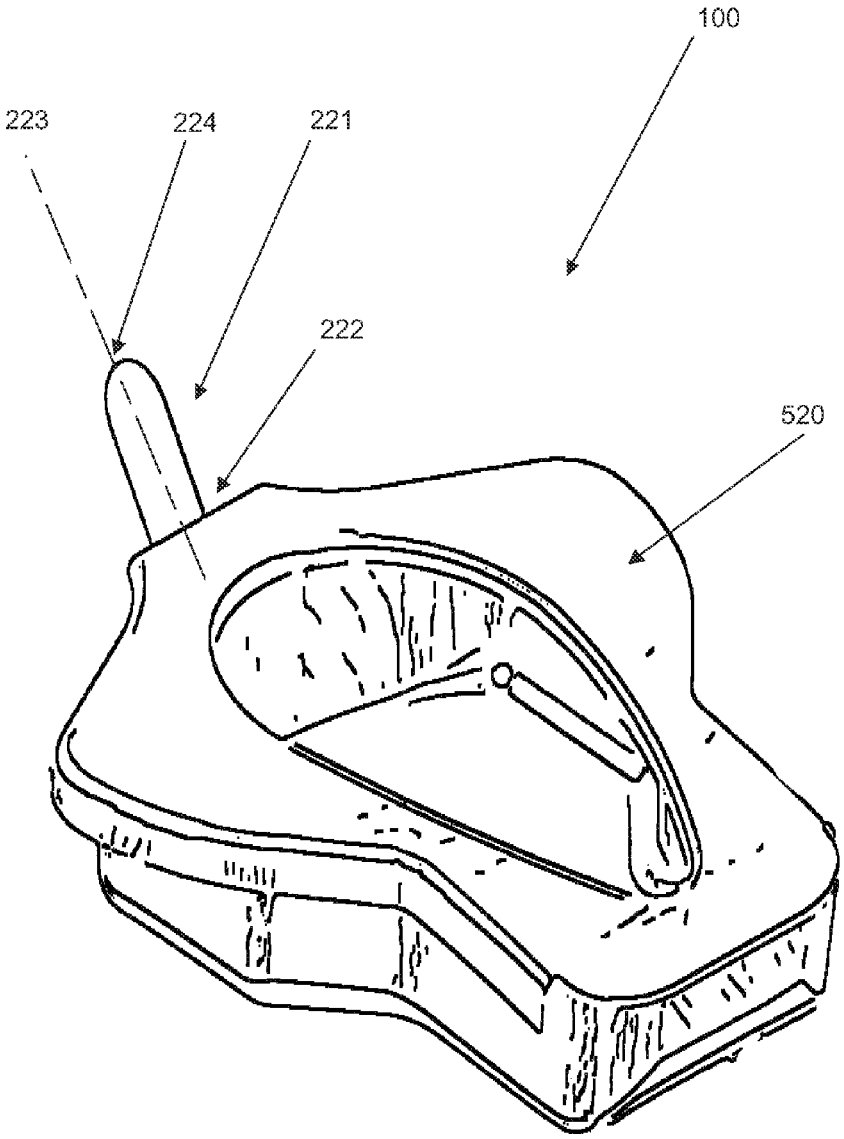
FIG. 23 is a top oblique view of a bedpan according to embodiments of the present invention.

Various embodiments of the present inventive bedpan incorporate a spatula to facilitate the use of the bedpan. The spatula can be used to guide the bedpan into position under a user and to hold the bedpan in place under the user while the user becomes situated onto the bedpan for use. In various embodiments, the spatula can be elongate, roughly planar, and rectangular in shape, and can be have a thin thickness creating perimeter edges. The spatula can form an extension from the bedpan, with an attachment to the bedpan along one of the shorter edges. The spatula can be fixed to the lid or to the receptacle base. FIG. 23 shows bedpan 100 showing spatula 221. In various embodiments, the spatula can be between approximately 1 cm (0.4 in.) and 5 cm (2 in.) wide, for example approximately 4 cm (0.8 in.) wide and between approximately 4 cm (0.8 in.) and 15 cm (6 in.) long, such as approximately 10 cm (4 in.) long. The spatula 221 can be uniform in shape or can have a wider distal end and a narrower proximal end, or a wider proximal end and a narrower distal end, or can have a wide mid-section and be narrower toward the distal end and the proximal end.

Figure 24:
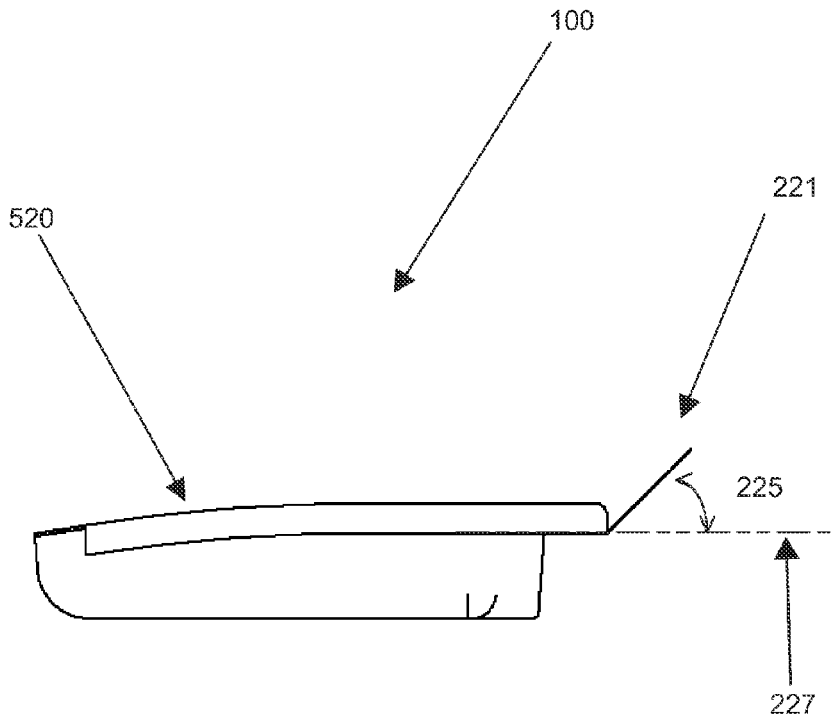
FIG. 24 is a side view of a bedpan according to embodiments of the present invention.
Figure 25:
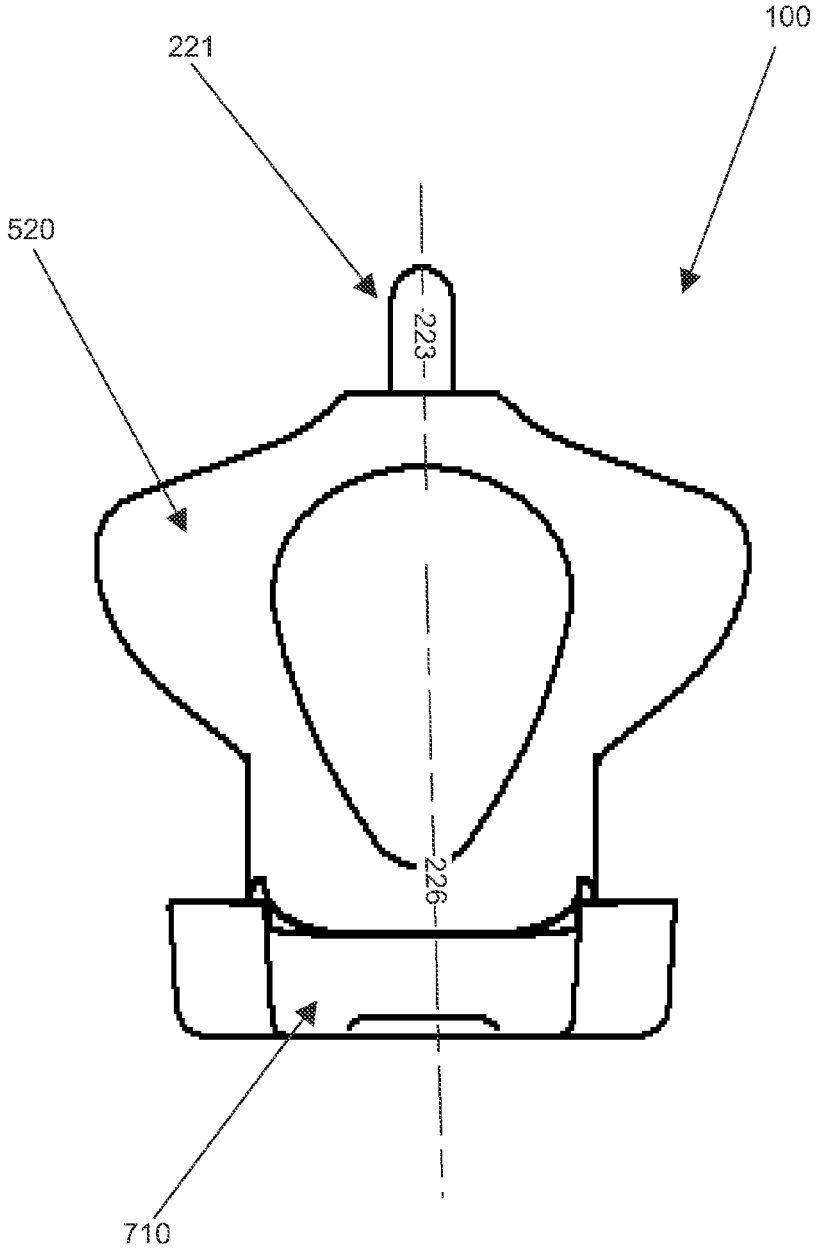
FIG. 25 is a front view of a bedpan according to embodiments of the present invention.

As shown in FIG. 23, spatula 221 can be fixed to the bedpan, for example near the proximal end of bedpan 100 to the upper portion of the lid 520. The spatula 221 can have a proximal end 222 on one end of its longitudinal axis 223, and a distal end 224 on the opposite end of the longitudinal axis 223 from the proximal end 222. The proximal end 222 can be near the attachment point of the spatula to the bedpan 100, with the distal end 224 defining an insertion tip. The distal end 224 can define a rounded off insertion tip with no sharp corners for ease of insertion under the user. FIG. 24 shows a side view of bedpan 100, showing spatula 221. The spatula 221 can extend from the bedpan 100 at a spatula angle 225 between 15 and 90 degrees from the imaginary horizontal plane 227 described by the upper surface of the lid 520. FIG. 25 shows bedpan 100 with receptacle base 110 and lid 520 in an open configuration. FIG. 25 shows spatula 221 extending from lid 520. The longitudinal axis 223 of the spatula 221 can be roughly parallel to the longitudinal centerline of the bedpan 226, bisecting the center of the bedpan 100 from the center of the proximal side wall (not shown) to the center of the distal side wall 710.

In use, the flexible spatula can be used to secure the bedpan in place under a user's buttocks while raising the user's torso up and onto the bedpan, for example by first having the user lie horizontally in bed. A caregiver can raise the user's knees, causing the user's legs to form a triangle when seen from side. At this point caregiver can place the bedpan against user's buttocks, inserting the flexible spatula between user's lower back and bed. At the same time the bedpan is thereby fixed at user's buttocks, the attendant can place the bottom corner of the bedpan into the articulation or inflection point of the mattress so that the bedpan can pivot around this point and down onto the lower portion of the bed when the attendant raises the upper portion of the bed, and with it, the upper body and torso of the user. Thereby, the user automatically sits on bedpan while bed inclines, and the spatula keeps the bedpan properly positioned and prevents it from sliding out from under the user during this process.

Various embodiments of the present invention further incorporate a disposable bag, such as a disposable plastic bag. In various embodiments, the disposable bag is in general a conventional rectangular disposable bag formed by various methods as are well known, such as from two films of plastic with a rectangular shape thermally sealed to each other along two lateral and one of the end sides, or formed by a cylindrical plastic film flattened and thermally sealed by only one of the shorter sides. Other types of disposable bags can be used as are known.

Figure 26:
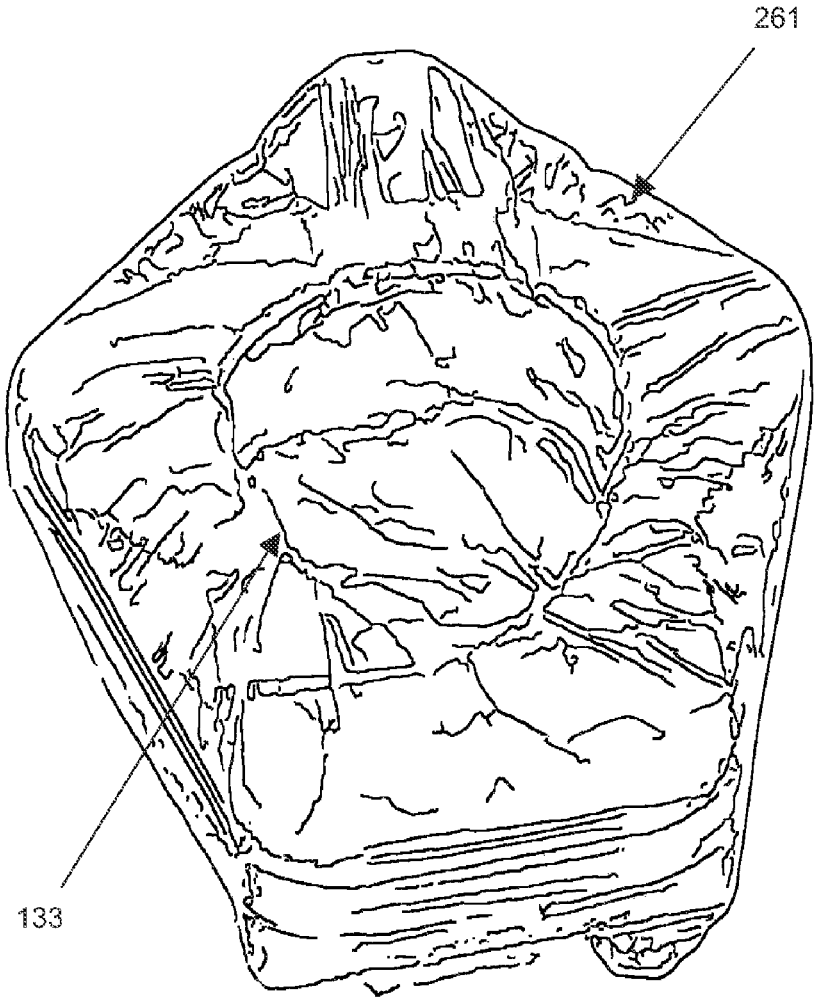
FIG. 26 is a top oblique view of a bedpan according to embodiments of the present invention.

The disposable bag can be shaped and dimensioned to fit over the exterior of the bedpan, with the lid in place and closed. In various embodiments, the disposable bag can be shaped to cover the exterior of the bedpan as well as to simultaneously line the interior of the receptacle base of the bedpan. In various embodiments, the disposable bag can be shaped to wrap over the bedpan as well as to extend through the orifice into the internal basin area of the receptacle base in order to receive the defecation and urine deposited by the user and to contain this waste until such time as it can be disposed of. FIG. 26 illustrates an embodiment of an exemplary bedpan in accordance with the present invention covered by a disposable bag 261. FIG. 26 illustrates that part of the disposable bag 261 is pushed through the orifice 133 into the interior of the receptacle base of the bedpan as a liner.

In such embodiments, in use, the disposable bag 261 can be drawn over the bedpan exterior, pushed through the orifice 133 into the internal basin of the receptacle base to line it, and the disposable bag can further be pushed into the open interface between the lid and the receptacle base, and the lid can be closed over the disposable bag to capture the bag in the joint between the lid and the receptacle base, for example to retain the disposable bag in position. In various embodiments, the disposable bag can be formed from plastic, be biodegradable, be rubber, polymer, or another material as is known in the art. The bag may be desirably watertight and waterproof at least over the time required for its immediate use.

Figure 27:
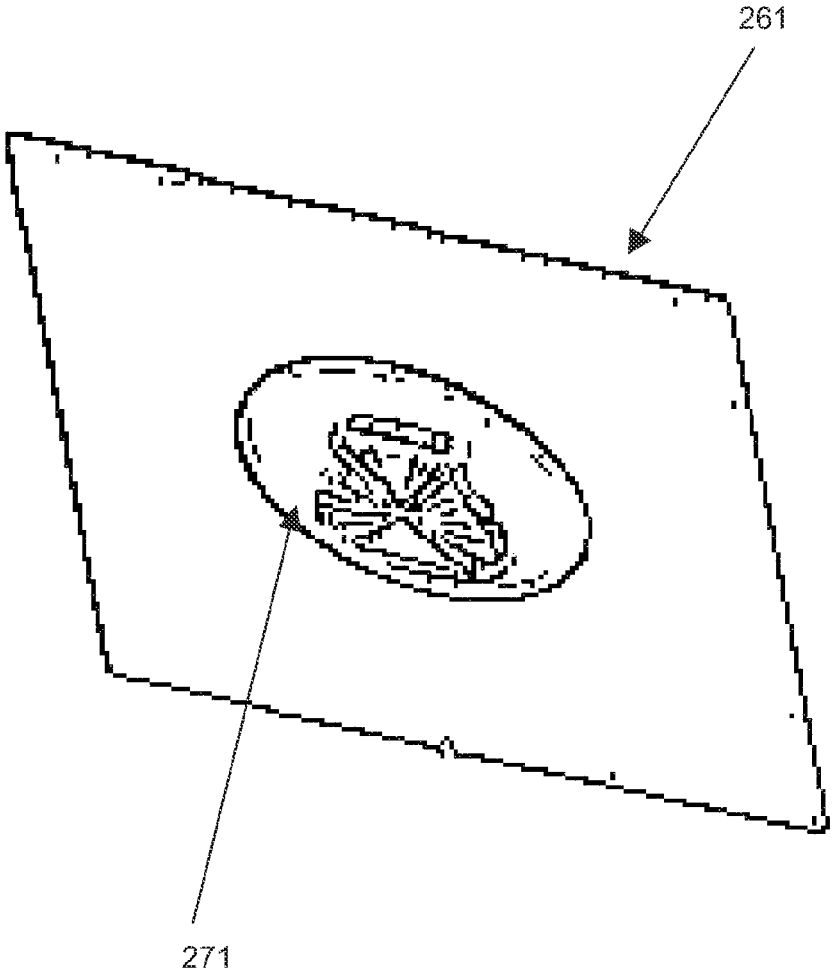
FIG. 27 is an oblique view of an element of a system according to embodiments of the present invention.

Various embodiments of the disposable bag can have a regular uniform bag shape with two laminar, roughly rectangular, planar sides joined together along three sides of a perimeter edge. In other embodiments, the disposable bag can be provided with a well portion, for example in one half of the bag, and configured to fit into and the interior basin of the receptacle base as a liner. One embodiment of the disposable bag has a well in one of its two side areas, with a similar form and volume to the bedpan interior receptacle base, to better serve as the receptacle that will receive the human waste. FIG. 27 illustrates one side of a disposable bag 261 consistent with embodiments of the present invention. FIG. 27 shows that the one side of disposable bag 261 can have a well 271, roughly dimensioned to match the inner contours of a receptacle base.

In such embodiments of the disposable bag 261, in use, the disposable bag 261 can be drawn over an embodiment of the inventive bedpan, covering its exterior. The well 271 can be pushed through the orifice of the lid of the bedpan by a user, such as a nurse or attendant, to line the basin interior of the receptacle base of the bedpan. Finally, the lid can be lifted slightly from the receptacle base by the user through the covering disposable bag 261 in order to open the joint between the lid and the receptacle base. Then, part of the bag material surrounding the upper perimeter of the well 271 can be pushed by the user into the open joint between the lid and the receptacle base, and the lid closed, trapping the disposable bag 261 and securing it in place for use. After use, the disposable bag 261 can be removed inside out to contain the human waste within the interior of the removed bag. After use, the "contents" can be dropped into a toilet or commode and the empty disposable bag 261 can be removed inside out and be disposed into the garbage. Alternatively, the used disposable bag 261 can be disposed into the garbage with its contents within, for example after being tied off or otherwise sealed, or without being tied off or otherwise sealed. In some embodiments, the disposable bag 261 can be biodegradable and flushable, and a used disposable bag 261 can be dropped into a toilet or commode with its contents within and flushed.

Some embodiments of the disposable bag can be provided with a trap ring comprising a separate piece of material, such as a ring or annular portion of the disposable bag, for example joined or thermally attached to the disposable bag along one edge, and configured to be trapped in the joint between the lid and the receptacle base in use. In some embodiments, the trap ring can have a width of between approximately 1 cm (0.4 in.) and 15 cm (6 in.), such as approximately 5 cm (2 in.) and can be attached along its inner circumferential edge to the interior of the upper side of the disposable bag. The trap ring can be formed from thicker or otherwise tougher material than the rest of the disposable bag to prevent the disposable bag being compromised, torn, or ripped in use when captured in the joint. In use, the reinforced portion can be trapped and fixed in place when the lid is closed and locked to the bedpan's base. This way the bag in use will be fixed to the bedpan, avoiding spills while pulling the bedpan out from the user. Some embodiments of the disposable bag are provided with one or more connection elements such as loops, hooks, tabs, or other attachment elements that can be used to secure the disposable bag to the bedpan, for example by coupling the connection elements to corresponding hooks, connectors, pins, posts, catches, snaps, or other connection means as are known, provided on the exterior or interior surface of the receptacle base or upper portion or underside of the lid.

Figure 28:
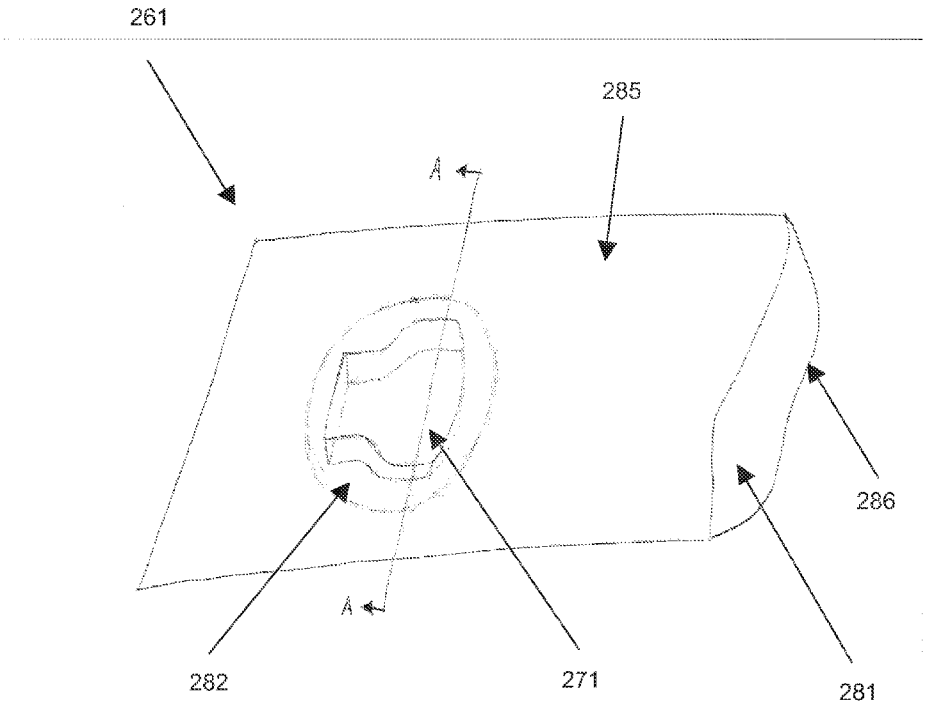
FIG. 28 is a top oblique view of an element of a system according to embodiments of the present invention.
Figure 29:
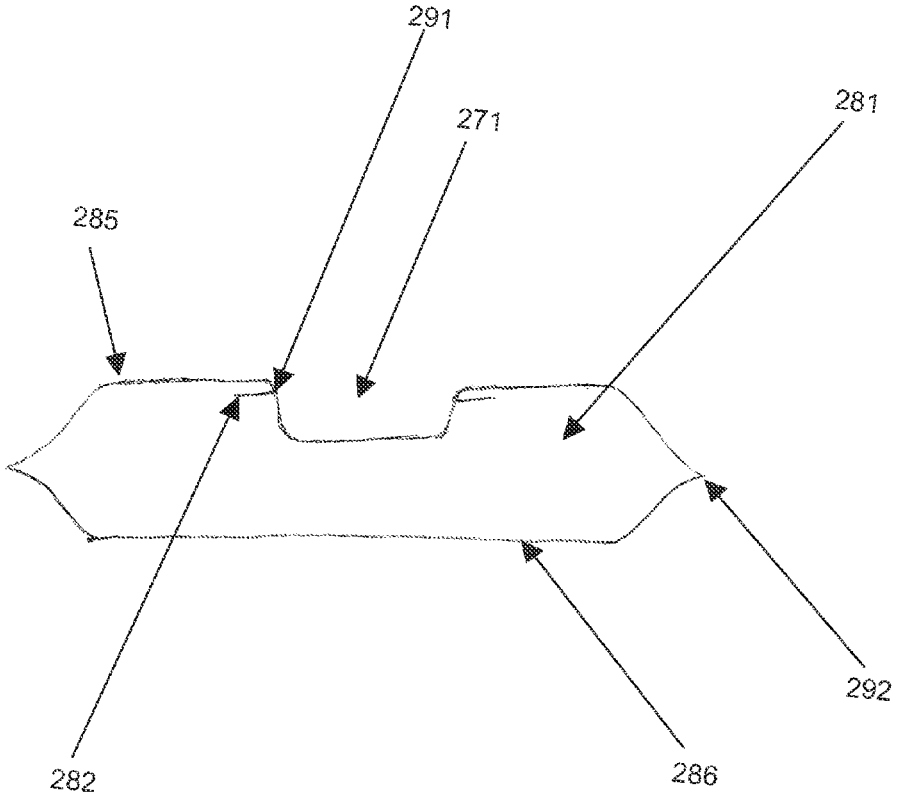
FIG. 29 is a sectional cut-away view of an element of a system according to embodiments of the present invention.

FIG. 28 illustrates an example of disposable bag 261. Disposable bag 261 is formed from two roughly planar sides, top side 285 and bottom side 286, fused together along their edges to form a bag. Disposable bag 261 has a bag interior 281 between the two sides. Disposable bag 261 is provided with a well 271 formed in one of the sides. Well 271 extends into the bag interior 281. Disposable bag 261 of FIG. 28 is substantially transparent to facilitate viewing any contents. FIG. 28 illustrates trap ring 282, attached along its inner circumferential edge to the underside of the top side 285 of disposable bag 261, around the upper perimeter of the well 271. Trap ring 282 is visible through the transparent top side 285 of disposable bag 261, surrounding the well 271. Trap ring 282 is configured to be pushed into the joint between a bedpan lid and the bedpan receptacle base. FIG. 28 further illustrates lateral axis A extending across disposable bag 261. FIG. 29 illustrates a side sectional view of the disposable bag 261. FIG. 29 illustrates a sectional view of disposable bag 261 across lateral axis A. FIG. 29 illustrates well 271 extending into the bag interior 281. FIG. 29 further illustrates trap ring 282, attached along its inner circumferential edge 291 to the underside of the top side 285 of disposable bag 261 near the upper perimeter of well 271. FIG. 29 illustrates top side 285 joined to bottom side 286 along and edge seam 292.

Figure 30:
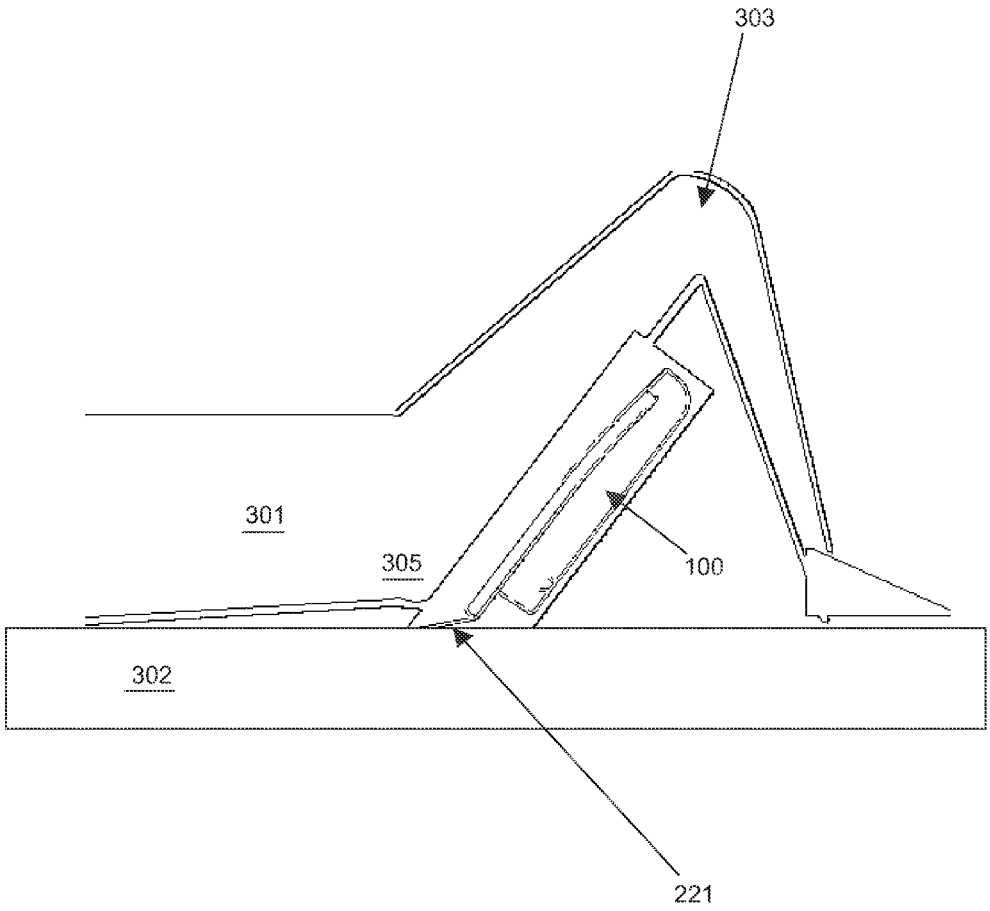
FIG. 30 is a diagram of a method according to embodiments of the present invention.
Figure 31:
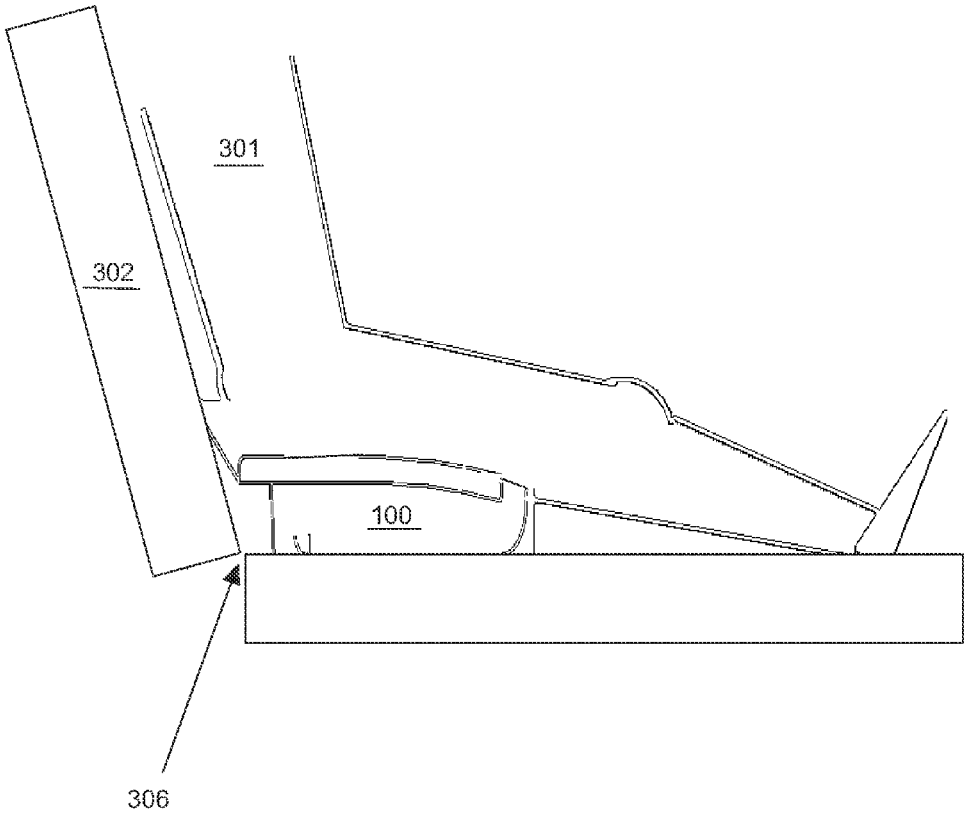
FIG. 31 is a diagram of a method according to embodiments of the present invention.

FIG. 30 illustrates an embodiment of the invention in use. In use, a user 301 lies flat in inclining bed 302 in a roughly horizontal position. The user 301 raises his knees 303 and an attendant slides the spatula 221 of the inventive bedpan 100 between user's buttocks 305 and the inclining bed 302. This will keep the bedpan 100 fixed in a raised position against user's buttocks 305. Referring now to FIG. 31, the attendant or nurse inclines the upper (torso) portion of the inclining bed 302 upward, catching the bedpan 100 in the mattress inflection point 306 where the inclining bed 302 is folding, and lifting the user 301 into a seated position over the bedpan 100. This method uses the power of the inclining bed 302 to assist with the correct placement of the bedpan 100. This method therefore helps to avoid nurse's injuries in the lower back. This method is less invasive to user's privacy. The user 301 then defecates and voids into the bedpan 100 as necessary. Once the user 301 is done, the nurse can recline the user 301, remove the bedpan 100 from under the user 301, unlock bedpan lid to release and remove the flexible disposable bag from the bedpan, remove the disposable bag from the bedpan 100 by peeling it back over itself to catch the contents within the disposable bag, and dispose the bag and/or drop its contents into a lavatory. The attendant can then draw a new disposable bag from the dispenser cartridge and pull it over the bedpan to prepare it once again for use.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents. While the present invention has been described in connection with a series of preferred embodiment, these descriptions are not intended to limit the scope of the invention to the particular forms set forth herein. It will be further understood that the methods of the invention are not necessarily limited to the discrete steps or the order of the steps described. To the contrary, the present descriptions are intended to cover such alternatives, modifications, and equivalents as can be included within the spirit and scope of the invention as defined by the present appended claims and otherwise appreciated by one of ordinary skill in the art.

As these embodiments of the present invention are described with reference to illustrations, various modifications or adaptations of the methods and or specific structures described can become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A bedpan for collecting biological waste from a human person, comprising:

a receptacle base having a floor, a side wall extending from the floor, and a substantially open top, the floor and side wall defining a receptacle base interior;

a lid engagable with the receptacle base to cover the substantially open top of the receptacle base, the lid having an upper surface and an underside opposite the upper surface, the lid being provided with an aperture therethrough;

a disposable bag, the disposable bag being flexible and substantially waterproof, and having one open end, the disposable bag having dimensions so as to allow the disposable bag to substantially cover the receptacle base and the lid, and to simultaneously substantially line the receptacle base interior;

a disposable bag dispenser configured to store and dispense a disposable bag; and, an elongate, substantially planar spatula having a longitudinal axis and having a distal end and a proximal end, the distal end provided on the opposite end of the longitudinal axis from the proximal end, the proximal end coupled to either the lid or to the receptacle base at a spatula joint, the spatula extending along the longitudinal axis away from the spatula joint.

2. The bedpan of claim 1, wherein the distal end of the spatula is rounded to facilitate insertion under the human person.

3. The bedpan of claim 1, wherein the lid is pivotably hinged to the receptacle base.

4. The bedpan of claim 1, wherein the underside of the lid is provided with an upper lid joint, and wherein the side wall is provided with a lower lid joint, and wherein the upper lid joint is configured to engage the lower lid joint, and wherein a portion of the disposable bag is configured to be inserted between the upper lid joint and the lower lid joint.

5. The bedpan of claim 1, wherein the disposable bag is provided with a contoured bag well configured to fit within the receptacle base interior.

6. The bedpan of claim 1, wherein the receptacle base is provided with a handhold.

7. The bedpan of claim 1, wherein the lid is provided with a handhold.

8. The bedpan of claim 1, wherein the disposable bag is provided with an annular ring configured to be trapped between the lid and the receptacle base.

9. The bedpan of claim 1, wherein the bedpan has a proximal end collocated with the side wall of the bedpan arranged toward the head of the human person during use, and a distal end collocated with the side wall of the bedpan arranged toward the feet of the human person during use, and has two lateral sides, the two lateral sides disposed opposite each other along the portions of the side wall that are separated from each other by, and extend between, the proximal end and the distal end, and wherein the intersection of the floor and the side wall has an intersection radius, and wherein the intersection radius along the proximal end is less than 50% of the intersection radius along the lateral sides.

10. The bedpan of claim 1, wherein the receptacle base and the lid are made from injection molded plastic.

11. The bedpan of claim 1, wherein the underside of the lid is provided with a lid lock, and wherein the side wall is provided with a side wall lock releasably engagable to the lid lock to secure the lid over the receptacle base.

12. A method of collecting biological waste from a human person, the human person lying substantially horizontally on the human person's back on a reclinable bed with the human person's knees flexed to elevate the human person's thighs off of the reclinable bed, the method comprising:

inserting a bedpan into a disposable bag;

positioning the bedpan under the thighs and against the buttocks of the human person by sliding a spatula disposed on the bedpan under the lower back of the human person;

elevating the torso of the human person to lift the human person into a seated position on top of the bedpan by inclining the upper portion of the reclinable bed;

collecting the biological waste within the bedpan;

reclining the torso of the human person by reclining the upper portion of the reclinable bed;

removing the bedpan from the human person; and removing the disposable bag from the bedpan.

13. The method of claim 12, further comprising pushing a portion of the disposable bag into an interior region of the bedpan.

14. The method of claim 12, further comprising opening a lid of the bedpan;

pushing a part of the disposable bag into a joint between the lid and the remainder of the bedpan; and closing the lid of the bedpan to secure the disposable bag in place.

15. The method of claim 12, further comprising opening a lid of the bedpan;

pushing an annular ring, coupled to the disposable bag, into a joint between the remainder of the bedpan; and closing the lid of the bedpan to secure the annular ring in place.

16. The method of claim 12, further comprising dumping the biological waste into a commode and discarding the disposable bag.

17. The method of claim wherein removing the disposable bag from the bedpan comprises removing the disposable bag inside-out from the bedpan so as to capture the biological waste within the removed disposable bag.

18. The method of claim 12, further comprising withdrawing a disposable bag from a disposable bag dispenser integrated into a bedpan.

19. The method of claim 12, further comprising directing the human person to defecate and to void the human person's urinary bladder.

* * * * *